US007648305B2

(12) United States Patent
Beales

(10) Patent No.: US 7,648,305 B2
(45) Date of Patent: Jan. 19, 2010

(54) PIN GRABBER COUPLER

(75) Inventor: Robert William Beales, Surrey (CA)

(73) Assignee: CWS Industries (Mfg.) Corp., Surrey, British Columbia (CA)

( * ) Notice: Subject to any disclaimer, the term of this patent is extended or adjusted under 35 U.S.C. 154(b) by 278 days.

(21) Appl. No.: 11/672,786

(22) Filed: Feb. 8, 2007

(65) Prior Publication Data

US 2008/0193210 A1 Aug. 14, 2008

(51) Int. Cl.
*E02F 3/96* (2006.01)

(52) U.S. Cl. ..... 403/322.1; 403/328; 403/330; 37/468; 172/272; 414/723

(58) Field of Classification Search ..... 403/231, 403/322.1, 325, 328, 330, 321; 37/468, 903; 172/272; 414/705, 723
See application file for complete search history.

(56) References Cited

U.S. PATENT DOCUMENTS 6,379,075 B1 4/2002 Shamblin et al.
6,422,805 B1 7/2002 Miller et al.
6,481,124 B1 11/2002 Miller et al.
6,508,616 B2 1/2003 Hung
6,625,909 B1 9/2003 Miller et al.
6,691,438 B2 2/2004 Fatemi
6,699,001 B2 3/2004 Fatemi
6,718,663 B1 4/2004 Geraghty
6,881,002 B2 4/2005 Fatemi
6,902,346 B2 6/2005 Steig, Jr. et al.
6,922,926 B2 8/2005 Miller et al.
6,962,475 B2 11/2005 Fatemi
6,964,122 B2 11/2005 Cunningham et al.
2005/0169703 A1 8/2005 Fatemi (Continued)

FOREIGN PATENT DOCUMENTS

CA 2539045 3/2005

(Continued)

OTHER PUBLICATIONS

"CWS IMAC Fully Automatic Hydraulic Pin Grabber" Jul. 2006 brochure by CWS Industries, Surrey, BC, Canada.

(Continued)

*Primary Examiner*—Michael P Ferguson
(74) *Attorney, Agent, or Firm*—Oyen Wiggs Green & Mutala LLP

(57) ABSTRACT

Coupler has a safety lock and a latching hook. The safety lock pivots between an unlocked position in which it does not contact a first implement pin receivable within a pair of apertures, and a locked position in which it retains the first pin within the apertures. The latching hook pivots between an unlatched position in which it does not contact a second implement pin receivable within another pair of apertures, and a latched position in which it retains the second pin within the apertures. A spring biases the safety lock toward the locked position, maintaining engagement of the safety lock with the first pin and preventing its withdrawal from the apertures in the event of a hydraulic system failure. When the implement is released, the spring continues to bias the safety lock toward the locked position, preventing withdrawal of the first pin from the apertures in the event of a hydraulic system failure before completion of the release operation.

17 Claims, 28 Drawing Sheets

U.S. PATENT DOCUMENTS

| | | | | |
|---|---|---|---|---|
| 2005/0214105 | A1 | 9/2005 | Steig, Jr. et al. | |
| 2007/0166143 | A1 * | 7/2007 | Hart et al. | 414/723 |

FOREIGN PATENT DOCUMENTS

| | | | |
|---|---|---|---|
| IE | S2004/0194 | | 3/2005 |
| IE | S2004/0192 | | 10/2005 |
| IE | S2005/0169 | | 10/2005 |
| JP | 06-264466 | * | 9/1994 |
| WO | WO 2005/026454 | * | 3/2005 |

OTHER PUBLICATIONS

"CWS Quick Coupler CWS-Dromone Pin Grabber" Mar. 2005 brochure by CWS Industries, Surrey, BC, Canada.

"Hendrix Hydraulic Quick Couplers" 2003 web site brochure by Hendrix Manufacturing, Ltd. of Mansfield, Louisiana; see http://www.hendrixmfg.com/__Quick__Coupler__.php.

"RotoLoc® Picks up where others leave off" undated brochure by JRB Attachments LLC of Akron, Ohio.

* cited by examiner

PIN GRABBER COUPLER

BACKROUND OF THE INVENTION

This disclosure pertains to a coupler for releasably and lockably coupling an implement such as a bucket to the end of a boom, with the coupler having a mechanism for inhibiting unintentional release of the implement.

BRIEF SUMMARY OF THE INVENTION

Powered digging or material-moving machines such as excavators and backhoes typically have an operator-manipulable boom to which one of a variety of implements can be coupled. Typical implements include buckets of various sizes and shapes, rakes, clamshells, grab-buckets, rippers, augers, grapples, hammers, etc.

The machine operator must sometimes interchange implements to perform different tasks. For example, an operator moving loose material with a bucket may encounter hard material which must be broken up before it may be moved with a bucket. In such a case, the operator may wish to remove the bucket from the machine's boom, mount a ripper on the boom, use the ripper to break up the hard material, then remove the ripper and remount the bucket in order to continue moving the broken material.

A coupler is commonly fixed at the end of the boom. The coupler includes a mechanism for coupling any one of the implements to the boom. The implements are adapted for such coupling by providing them with mounting pins which are engaged by the coupler in well known fashion. The coupler can be actuated by the operator in order to quickly and easily decouple an implement from the machine then recouple it to another implement, without requiring the operator to leave the machine's operating cab.

If the mounting pins of an implement are not properly engaged by the coupler it is possible for the implement to suddenly and unexpectedly decouple from the machine's boom. If this happens damage or injury may be caused to the coupler, to the implement or to nearby items or persons. This problem is addressed by the coupler described below.

The foregoing examples of the related art and limitations related thereto are intended to be illustrative and not exclusive. Other limitations of the related art will become apparent to those of skill in the art upon a reading of the specification and a study of the drawings.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE INVENTION

Figure 1:
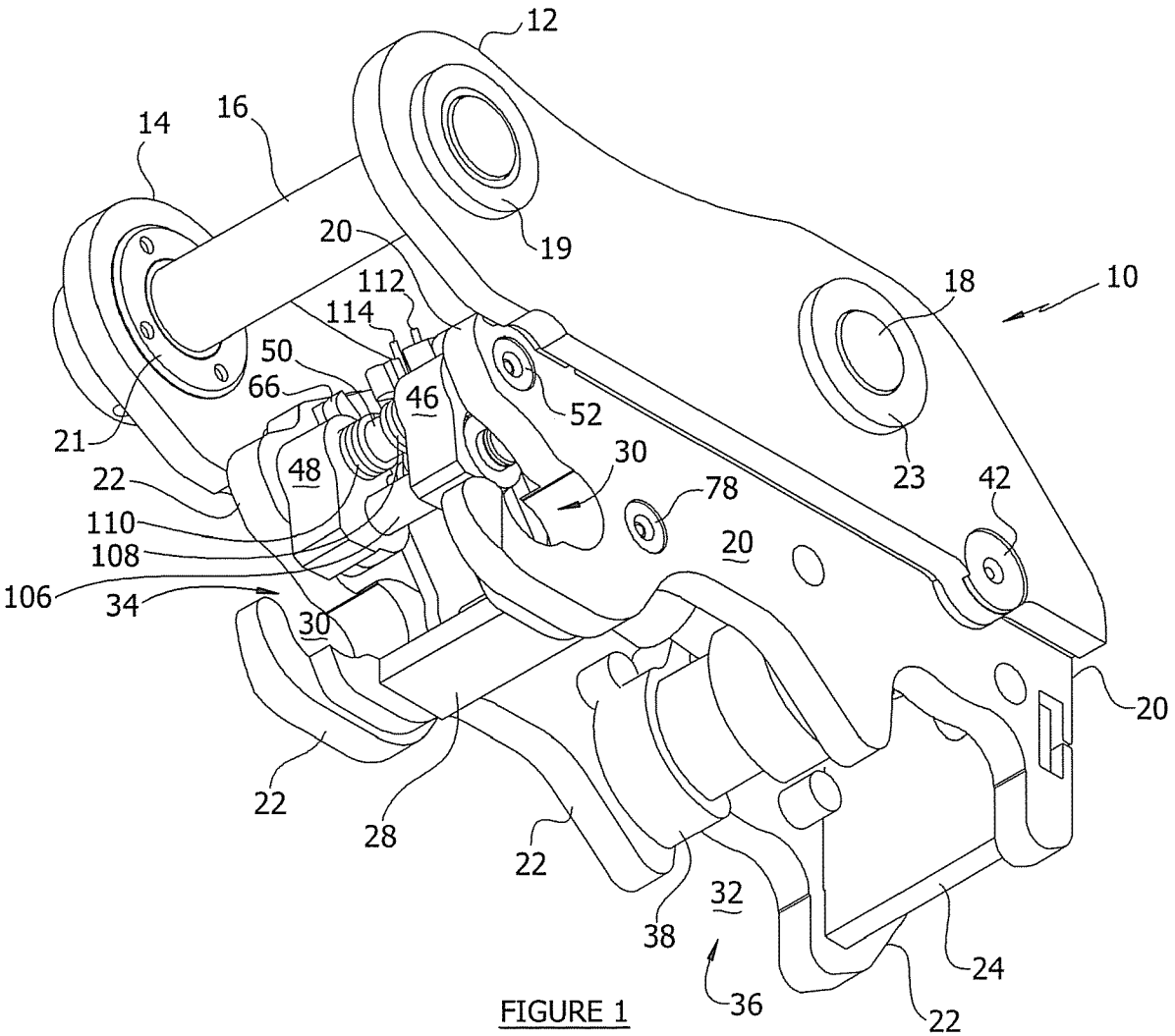
FIGS. 1 and 20 are respectively right and left side oblique lower front isometric views of the coupler.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Coupler 10 includes right and left upper side plates 12, 14 which transversely locate pins 16, 18. Plates 12, 14 are fixed in spaced-apart, substantially parallel relationship by right and left lower side plates 20, 22. Plates 20, 22 are in turn fixed in spaced-apart, substantially parallel relationship by flanges 24, 26, 28. More particularly, the right and left outward ends of rearward flange 24 bridge across and are welded to the inward sides of side plates 12, 14, 20, 22. The right and left outward ends of upper and lower forward flanges 26, 28 are welded to the inward sides of lower side plates 20, 22. The opposed ends of pin 16 are journalled for rotation in bearings 19, 21 which are mounted in the upper forward ends of right and left upper side plates 12, 14 respectively. The opposed ends of pin 18 are journalled and fixed in bearings 23, 25 which are mounted toward the rearward ends of right and left upper side plates 12, 14 respectively.

Transversely aligned forward pin-receiving apertures 30 are formed in the forward ends of lower side plates 20, 22. Transversely aligned rearward pin-receiving apertures 32 are formed in the rearward ends of lower side plates 20, 22. Forward pin-receiving apertures 30 have upward and forward-facing openings 34. Rearward pin-receiving apertures 32 have downward-facing openings 36.

Latching hook 38 (best seen in FIGS. 6 and 25) is pivotally mounted on pin 40 which extends through latching hook 38's upper aperture 41. The right end of pin 40 is journalled for rotation in bearing 42 (FIG. 1) which is mounted in the lower rearward end of upper side plate 12 and in the upper rearward end of lower side plate 20. The left end of pin 40 is journalled for rotation in bearing 44 (FIG. 20) which is mounted opposite bearing 42 in the lower rearward end of upper side plate 14 and in the upper rearward end of lower side plate 22.

Figure 4:
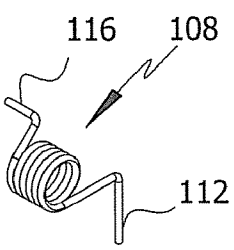
FIGS. 4 and 23 are respectively right and left side isometric views of one of the coupler's torsion springs.
Figure 3:
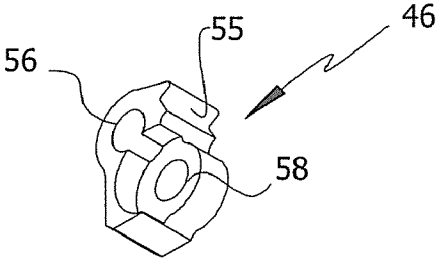
FIGS. 3 and 22 are respectively right and left side isometric views of one of the coupler's safety locks.
Figure 20:
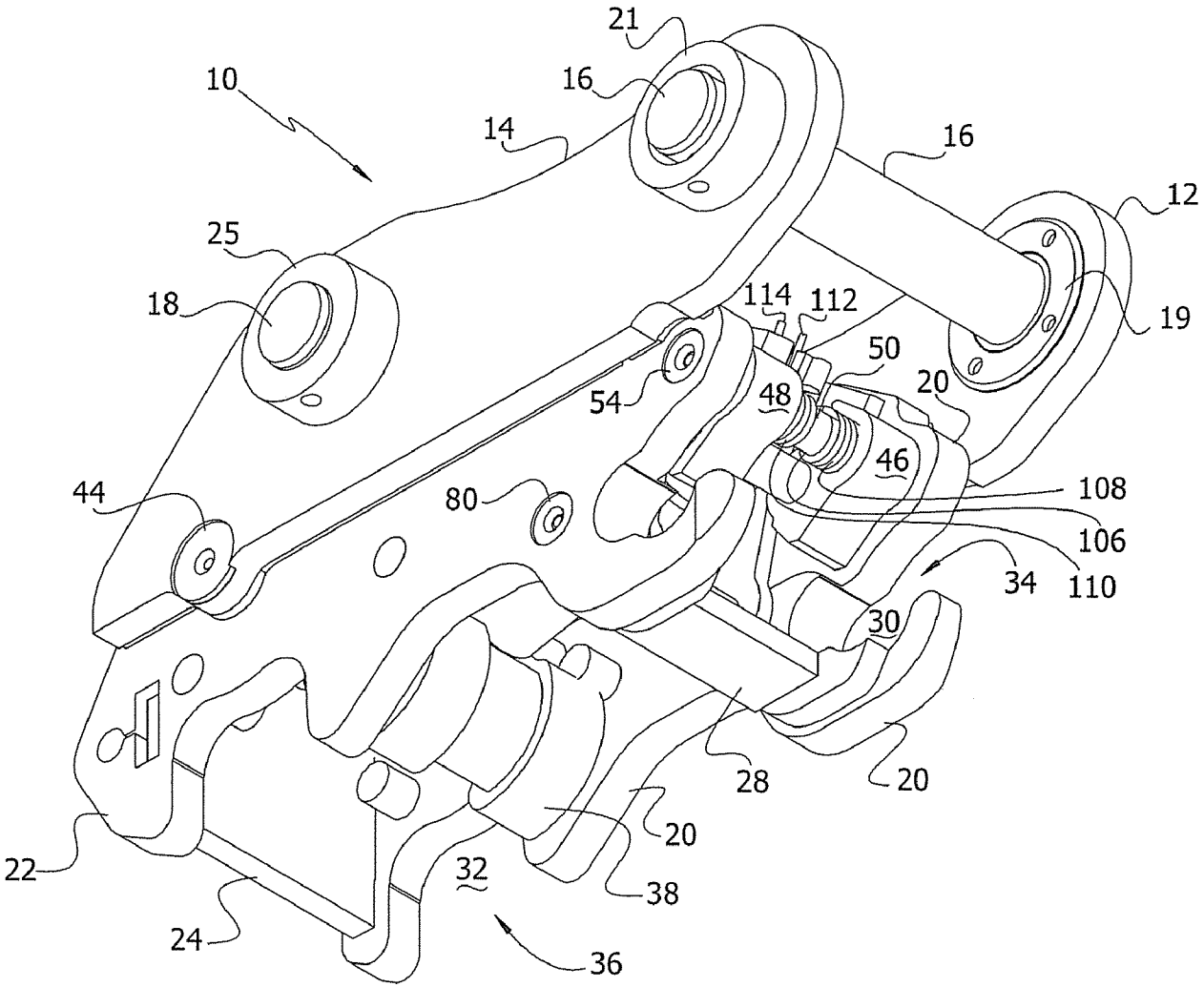
Figure 23:
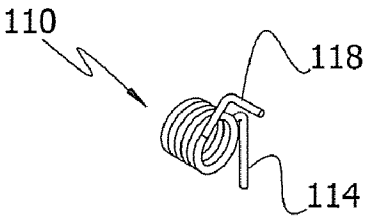
Figure 22:
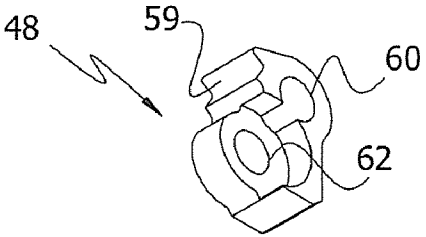

Right side safety lock 46 (best seen in FIG. 3) has a ratchet face 55 and upper and lower apertures 56, 58. Left side safety lock 48 (best seen in FIG. 22) has a corresponding ratchet face 59 and upper and lower apertures 60, 62. Right side torsion spring 108 (best seen in FIG. 4) is positioned on the inward side of right side safety lock 46 to transversely align the coiled portion of spring 108 with aperture 56. Left side torsion spring 110 (best seen in FIG. 23) is positioned on the inward side of left side safety lock 48 to transversely align the coiled portion of spring 110 with aperture 60. Upper apertures 56, 60 are transversely aligned with one another and with the coiled portions of torsion springs 108, 110. Safety lock upper pivot pin 50 extends through apertures 56, 60 and through the coiled portions of right and left torsion springs 108, 110 as shown in FIGS. 1 and 20. The opposed ends of pin 50 are journalled for rotation in bearings 52, 54 which are mounted in the upper forward ends of lower side plates 20, 22 as shown in FIGS. 1 and 20 respectively. Safety locks 46, 48 are thus spaced apart and pivotally mounted on safety lock upper pivot pin 50.

Figure 5:
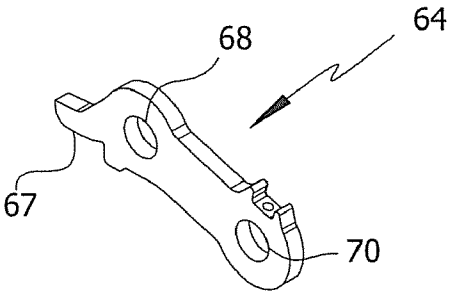
FIGS. 5 and 24 are respectively right and left side isometric views of one of the coupler's cylinder mount links.
Figure 10:
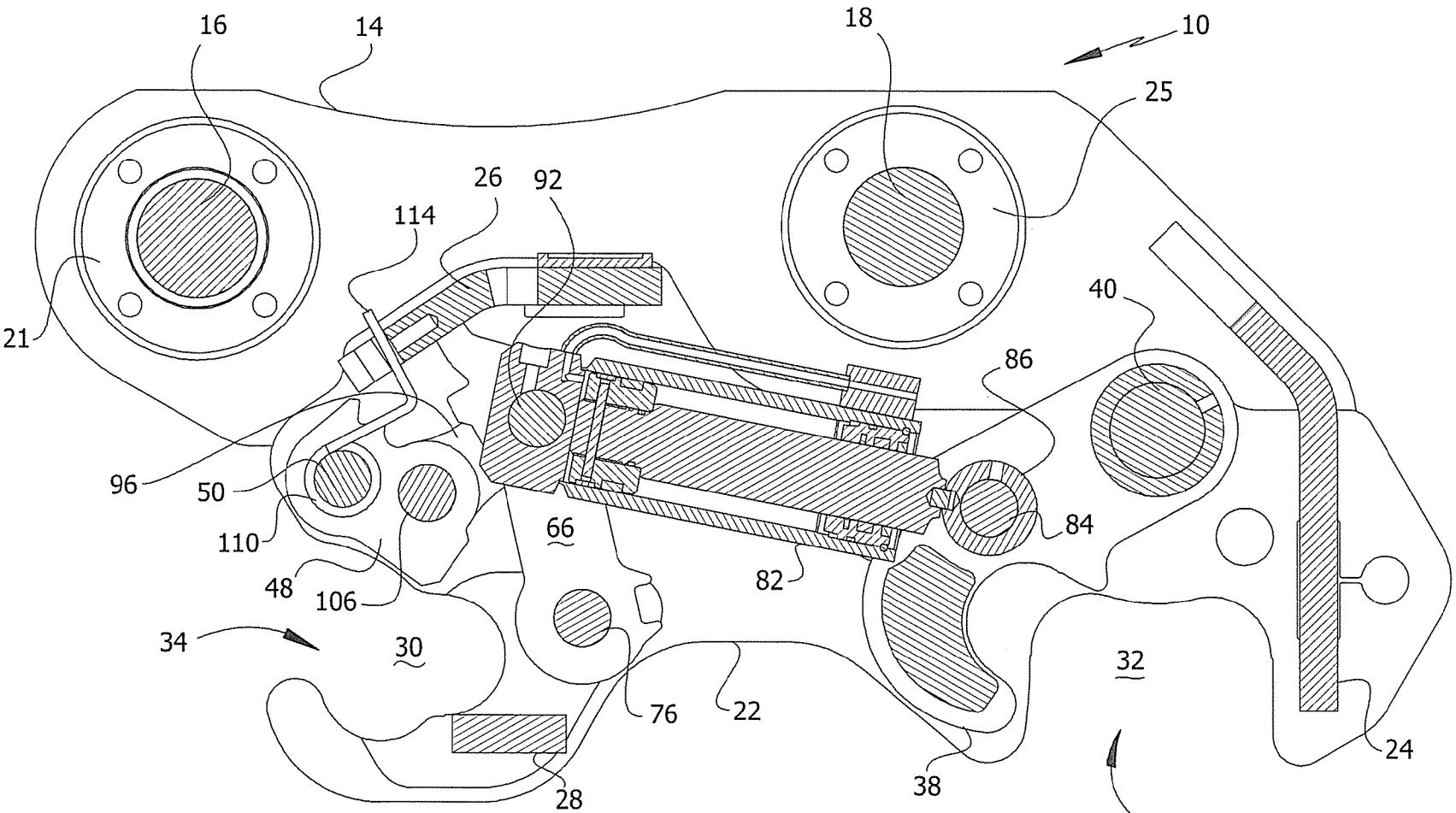
FIGS. 10 and 29 are respectively right and left side section views, on an enlarged scale, taken (FIG. 10) with respect to line 10-10 shown in FIG. 9 and (FIG. 29) with respect to line 29-29 shown in FIG. 28.
Figure 24:
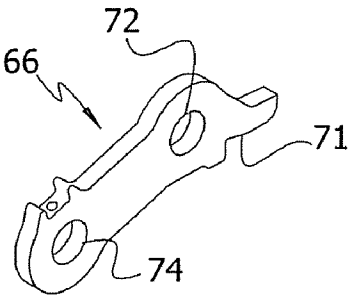
Figure 29:
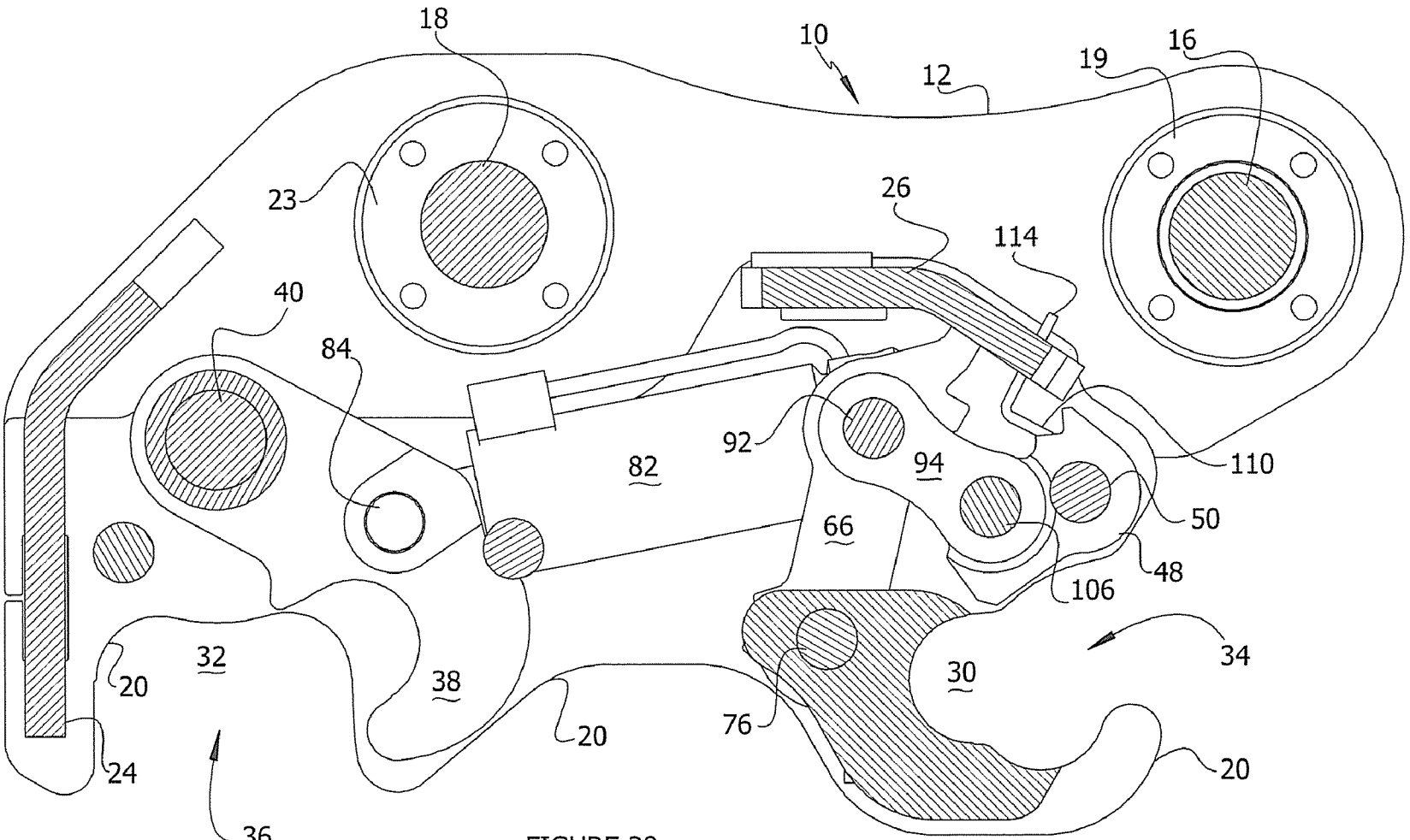

Right side cylinder mount link 64 (best seen in FIG. 5) has an engagement face 67 for engaging ratchet face 55 of right side safety lock 46 as explained below, and has upper forward and lower rearward apertures 68, 70. Left side cylinder mount link 66 (best seen in FIG. 24) has a corresponding engagement face 71 and upper forward and lower rearward apertures 72, 74. Lower rearward apertures 70, 74 are transversely aligned with one another; and upper forward apertures 68, 72 are transversely aligned with one another. Cylinder mount link pivot pin 76 extends through lower rearward apertures 70, 74 as shown, for example, in FIGS. 10 and 29. The opposed ends of pin 76 are journalled for rotation in bearings 78, 80 which are mounted in the lower forward ends of lower side plates 20, 22 respectively as shown in FIGS. 1 and 20 respectively. Cylinder mount links 64, 66 are thus spaced apart and pivotally mounted on cylinder mount link pivot pin 76.

Figure 7:
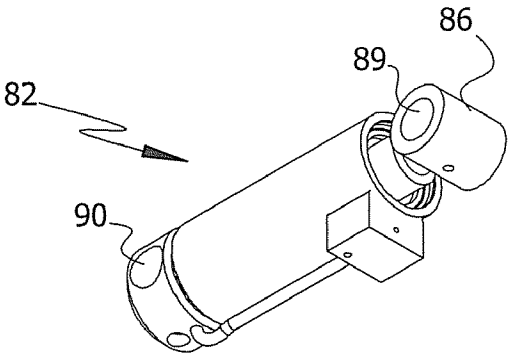
FIGS. 7 and 26 are respectively right and left side isometric views of the coupler's hydraulic cylinder.
Figure 6:
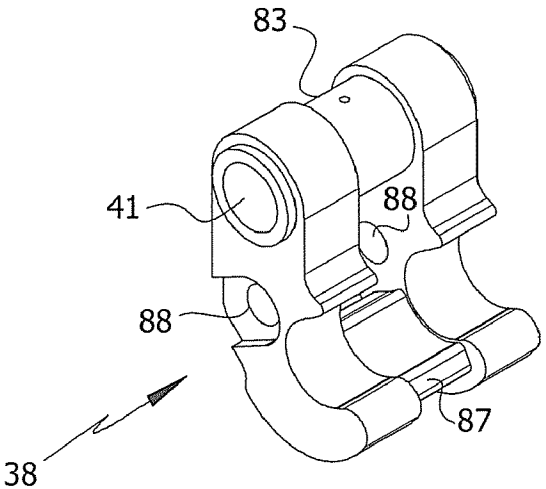
FIGS. 6 and 25 are respectively right and left side isometric views of the coupler's latching hook.
Figure 26:
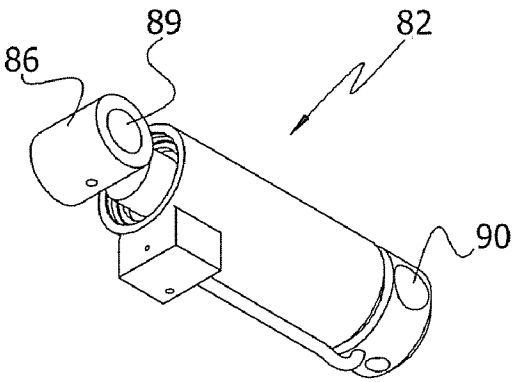
Figure 25:
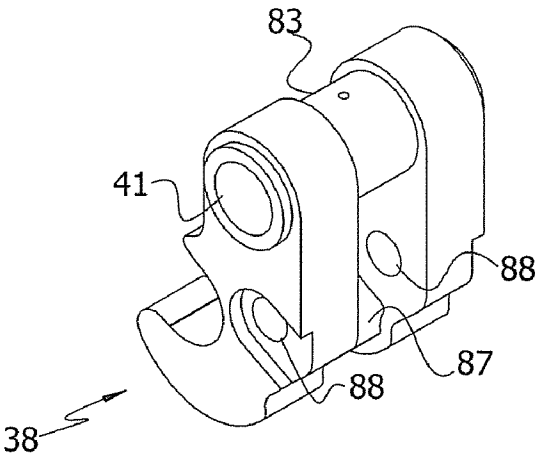

As best seen in FIGS. 6 and 25, latching hook 38 has right and left halves which are transversely aligned and joined by sleeve 83 and spacer 87. Latching hook 38's upper aperture 41 extends transversely through sleeve 83. Transversely aligned central apertures 88 extend through latching hook 38's right and left halves between sleeve 83 and spacer 87. Sleeve 86 is fixed on the rod end of hydraulic cylinder 82 (best seen in FIGS. 7 and 26). Sleeve 86 is positioned between latching hook 38's right and left halves to transversely align sleeve 86's aperture 89 with and between apertures 88. Cylinder rod end pivot pin 84 extends through apertures 88, 89 as shown, for example, in FIGS. 10 and 29. The rod end of hydraulic cylinder 82 is thus pivotally coupled to latching hook 38.

Figure 2:
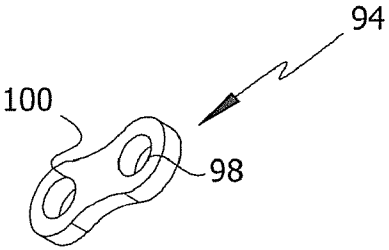
FIGS. 2 and 21 are respectively right and left side isometric views of one of the coupler's lock links.
Figure 11:
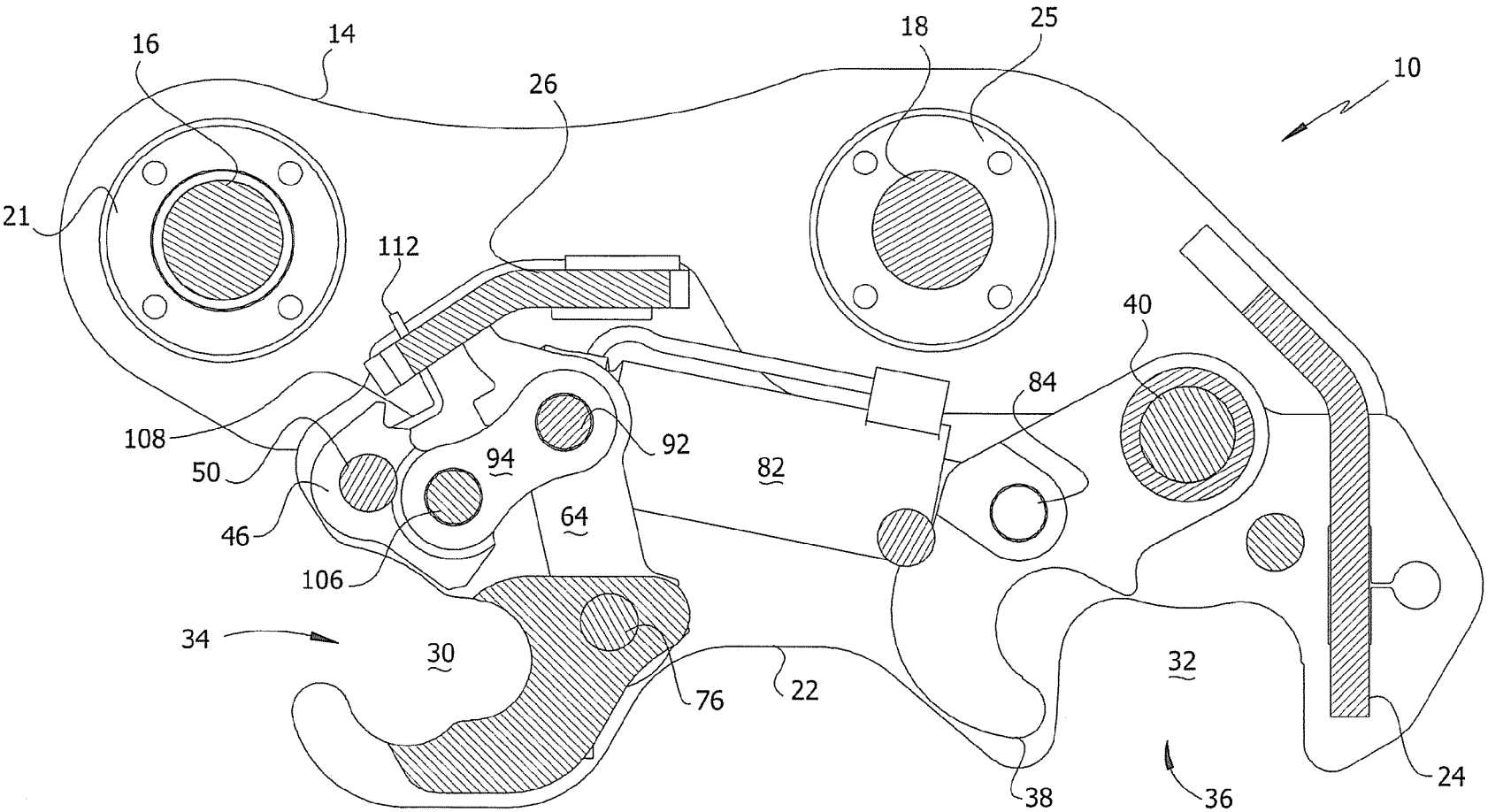
FIGS. 11 and 30 are respectively right and left side section views, on an enlarged scale, taken (FIG. 11) with respect to line 11-11 shown in FIG. 9 and (FIG. 30) with respect to line 30-30 shown in FIG. 28.
Figure 12:
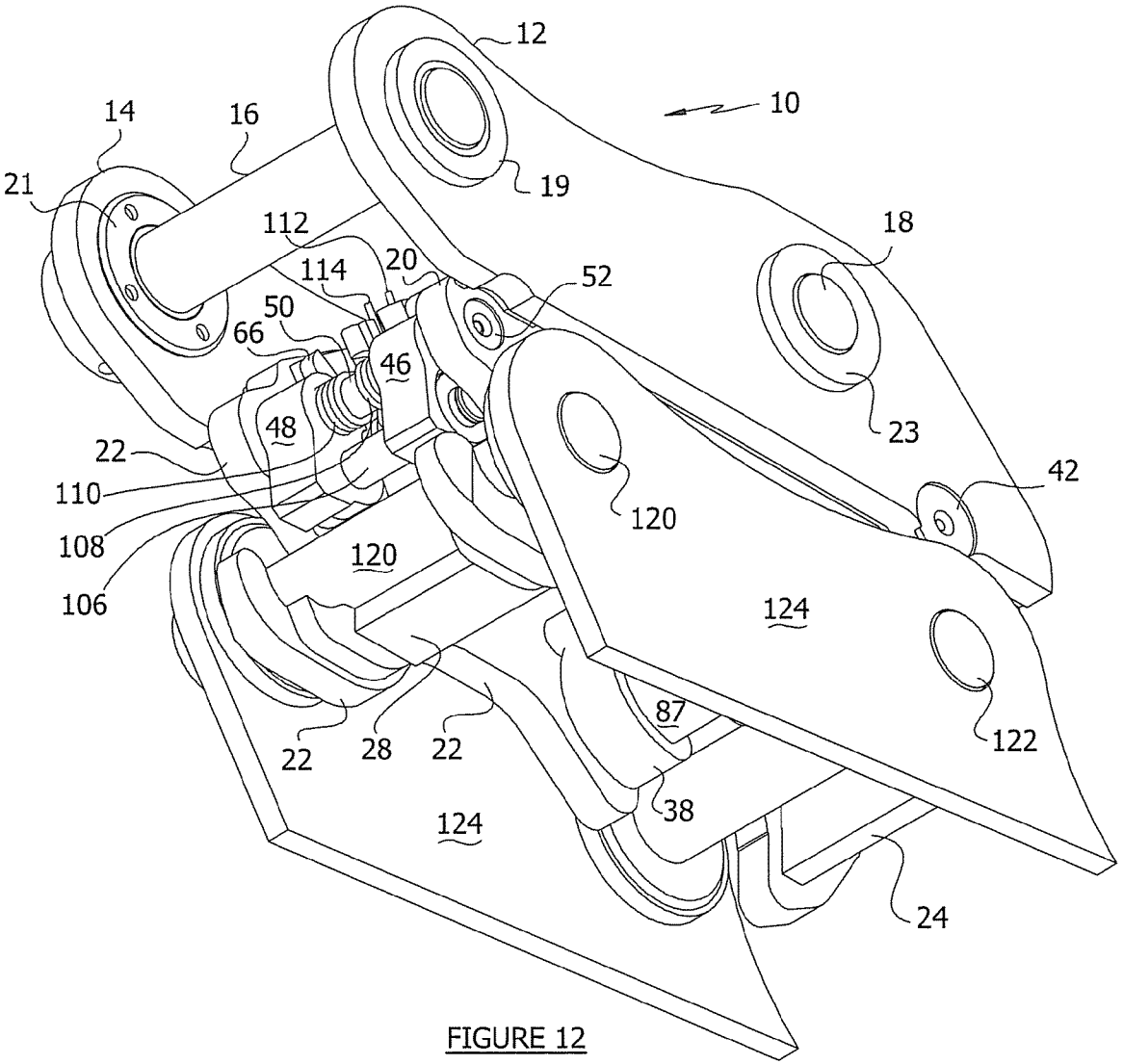
FIGS. 12 and 31 are similar to FIGS. 8 and 27 respectively, but show the coupler after activation of the safety locks and before activation of the latching hook.
Figure 13:
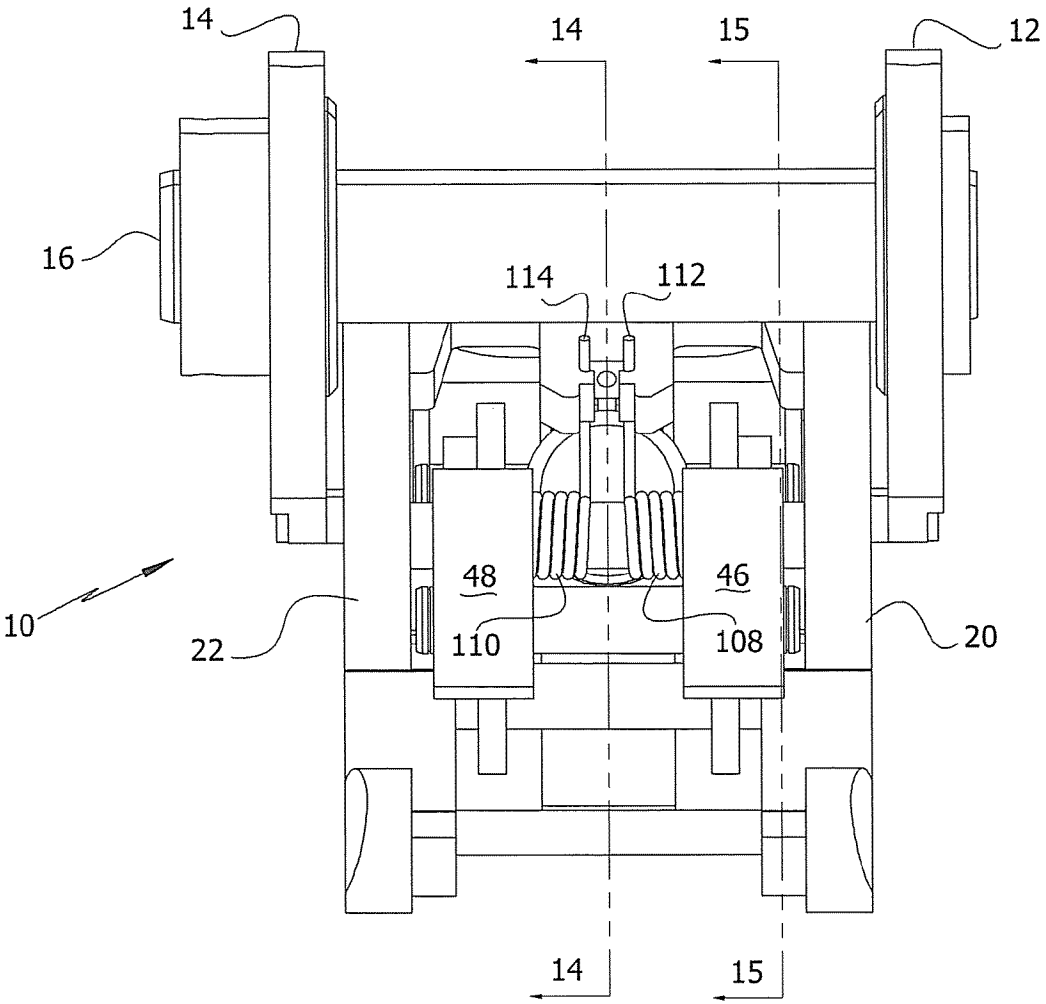
FIGS. 13 and 32 are respectively front elevation views, on an enlarged scale, of the coupler shown in FIGS. 12 and 31 respectively.
Figure 21:
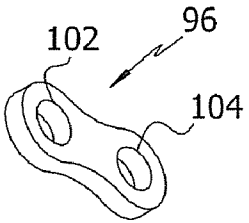
Figure 30:
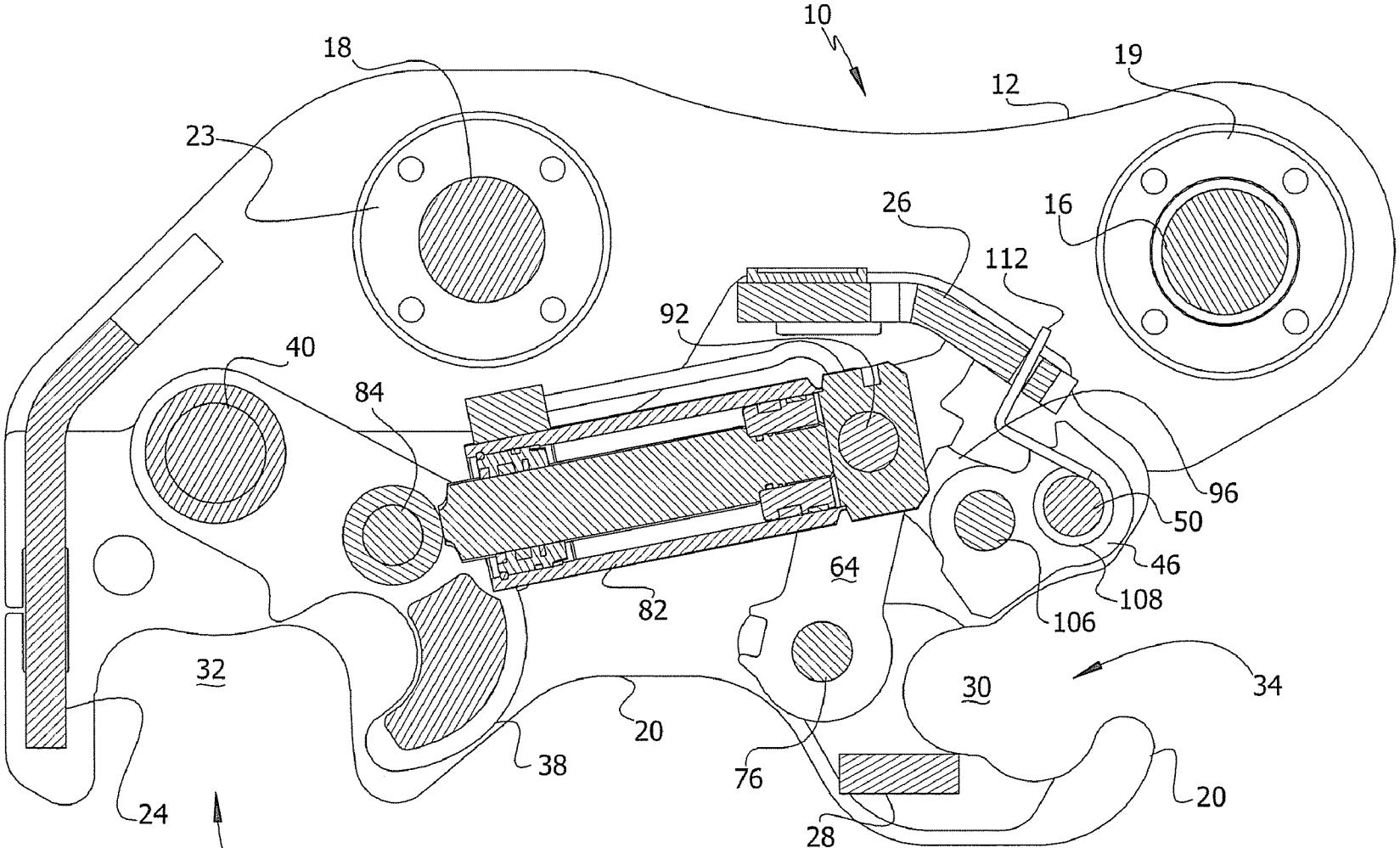
Figure 31:
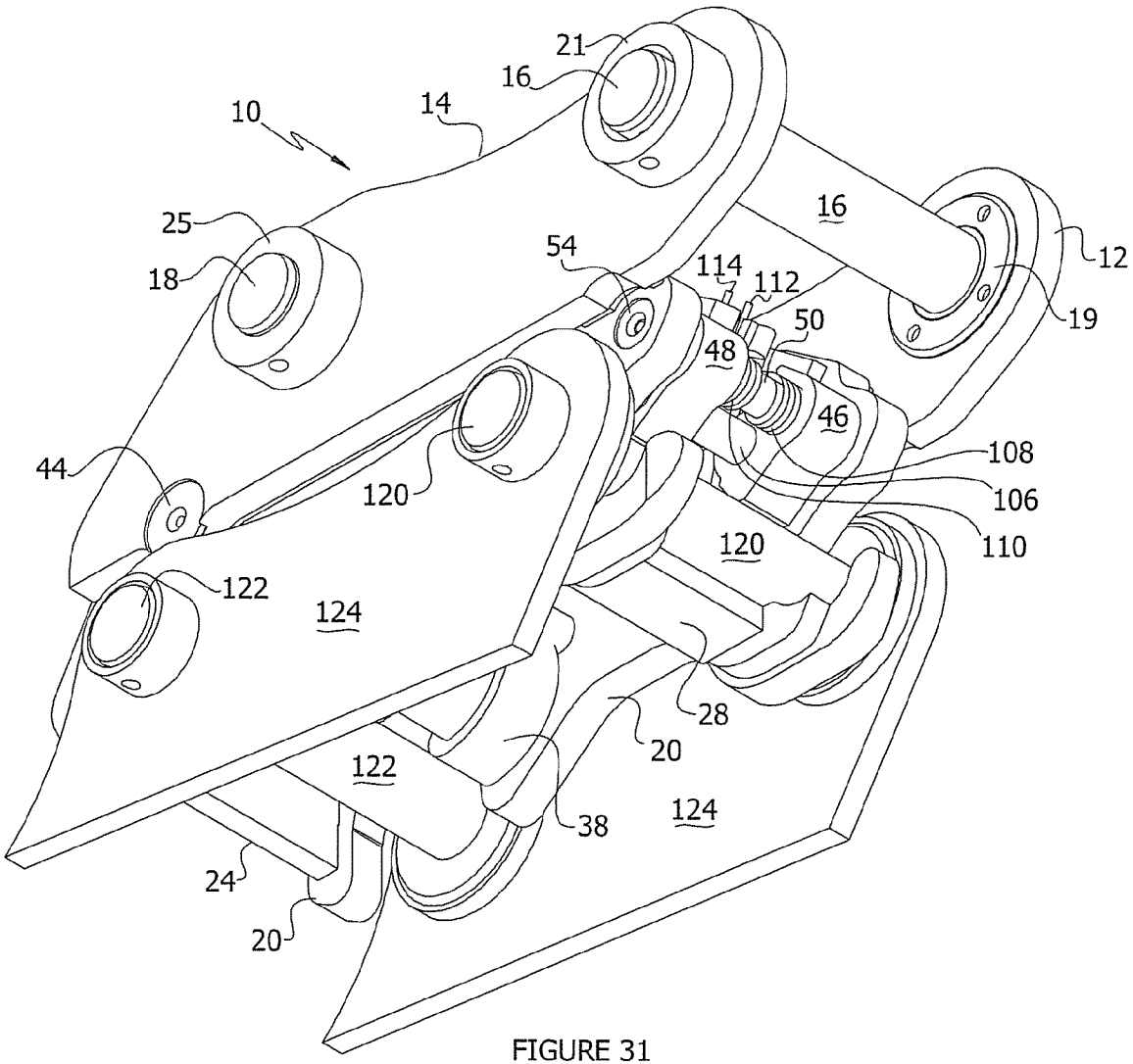
Figure 32:
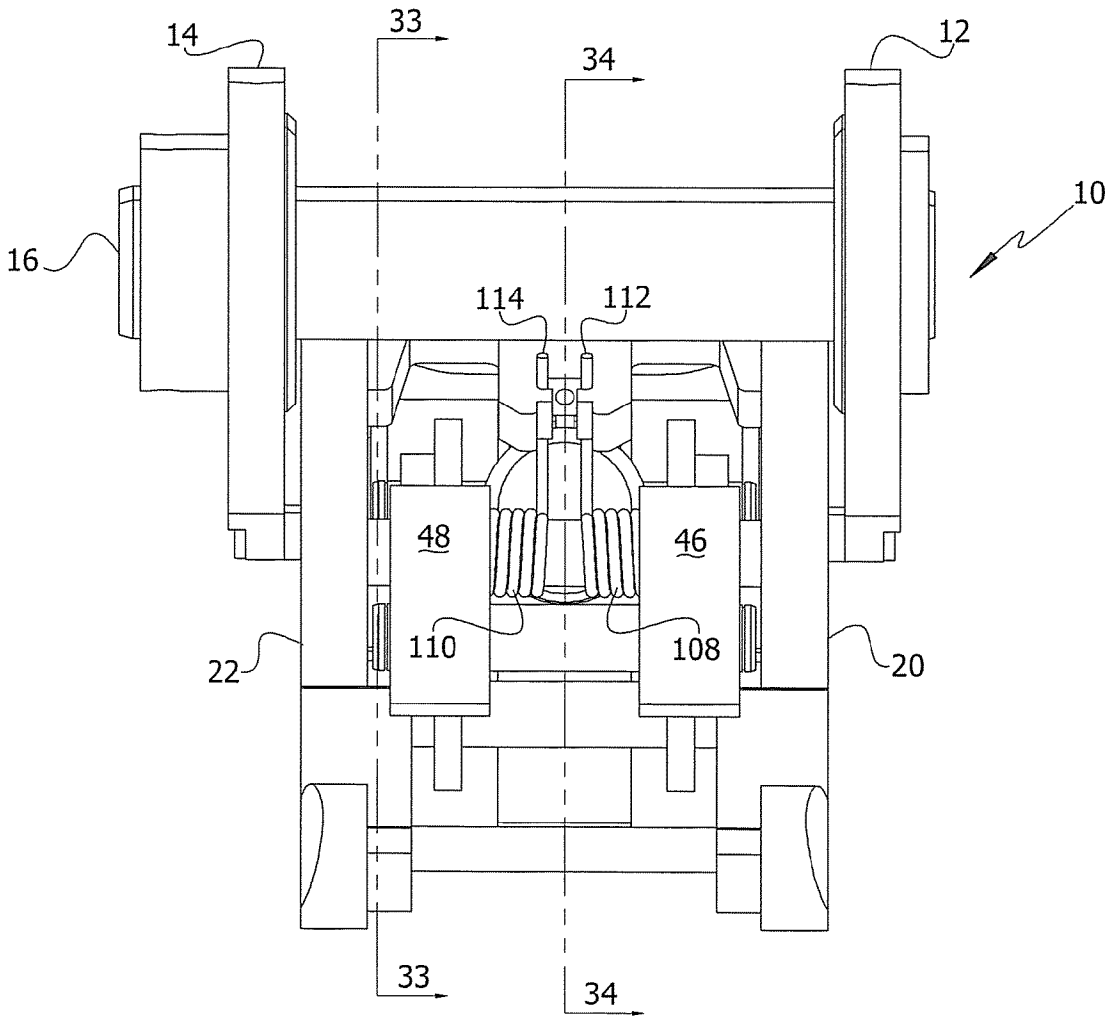

Right side lock link 94 (best seen in FIG. 2) has upper and lower apertures 98, 100. Left side lock link 96 (best seen in FIG. 21) has corresponding upper and lower apertures 102, 104. As previously explained, cylinder mount links 64, 66 are spaced apart on cylinder mount link pivot pin 76. Right side lock link 94 is positioned on the right side of right side cylinder mount link 64 to transversely align apertures 68, 98. Left side lock link 96 is positioned on the left side of left side cylinder mount link 66 to transversely align apertures 72, 102. The cylinder end of hydraulic cylinder 82 is positioned between cylinder mount links 64, 66 to transversely align cylinder end aperture 90 (best seen in FIGS. 7 and 26) with apertures 68, 72, 98, 102. Cylinder end pivot pin 92 extends through the aligned apertures 68, 72, 98, 102, 90 as shown, for example, in FIGS. 11 and 30. The cylinder end of hydraulic cylinder 82 is thus pivotally coupled to cylinder mount links 64, 66 and to lock links 94, 96.

As previously explained, safety locks 46, 48 are spaced apart on safety lock upper pivot pin 50. More particularly, right side lock link 94 is positioned on the right side of right side safety lock 46 to transversely align apertures 58, 100; and left side lock link 96 is positioned on the left side of left side safety lock 48 to transversely align apertures 62, 104. Safety lock lower pivot pin 106 extends through aligned apertures 58, 62, 100, 104 as shown, for example, in FIGS. 11 and 30. Lock links 94, 96 are thus pivotally coupled between safety locks 46, 48 and cylinder mount links 64, 66.

Right and left side torsion springs 108, 110 are coiled around safety lock upper pivot pin 50 as previously explained. The springs' upwardly extending ing ends 112, 114 bear against upper forward flange 26. The springs' transversely inwardly extending lower ends 116, 118 are seated within transverse recesses (not shown) in safety locks 46, 48 respectively. Springs 108, 110 thus bias safety locks 46, 48 clockwise with respect to safety lock upper pivot pin 50, as shown, for example, in FIGS. 10, 11, 14, 15, 18 and 19.

In operation, pins 16, 18 are coupled to a machine's boom (not shown) in well known fashion to mount coupler 10 on the end of the boom. The machine operator initially actuates a cab-mounted control mechanism (not shown) to fully retract hydraulic cylinder 82 into the retracted position best seen in FIGS. 10-11 and 29-30. Such retraction pivots latching hook 38 forwardly (i.e. clockwise about pivot pin 40, as viewed in FIGS. 10-11; and counterclockwise about pivot pin 40, as viewed in FIGS. 29-30) such that latching hook 38 is clear of rearward aperture 32; and pivots cylinder mount links 64, 66 rearwardly (i.e. clockwise about pivot pin 76, as viewed in FIGS. 10-11; and counterclockwise about pivot pin 76, as viewed in FIGS. 29-30). Such pivotal movement of cylinder mount links 64, 66 draws lock links 94, 96 rearwardly (i.e. toward the right, as viewed in FIGS. 10-11; and toward the left, as viewed in FIGS. 29-30) on cylinder end pivot pin 92. Since lock links 94, 96 are coupled between cylinder mount links 64, 66 and safety locks 46, 48 on pivot pins 76, 106 respectively, safety locks 46, 48 are also drawn rearwardly (i.e. pivoted counterclockwise about safety lock upper pivot pin 50 as viewed in FIGS. 10-11; and clockwise about pin 50 as viewed in FIGS. 29-30), such that safety locks 46, 48 are clear of aperture 30 as shown in FIGS. 8-11 and 27-30.

Figure 8:
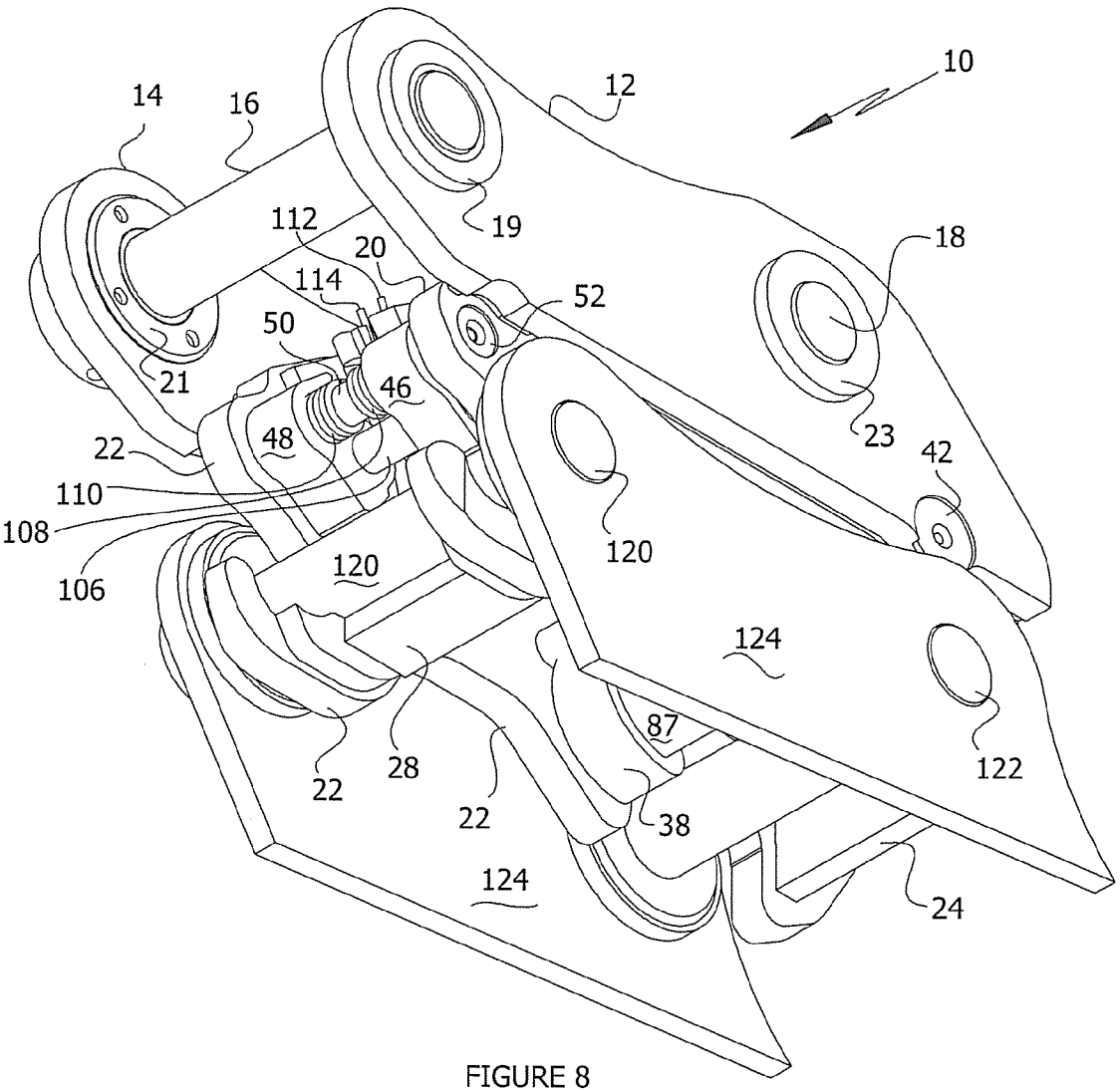
FIGS. 8 and 27 are respectively right and left side oblique lower front isometric views of the coupler, and depict a portion of an implement having forward and rearward pins respectively positioned within the coupler's forward and rearward coupling apertures before activation of the coupler's safety locks and latching hook.
Figure 9:
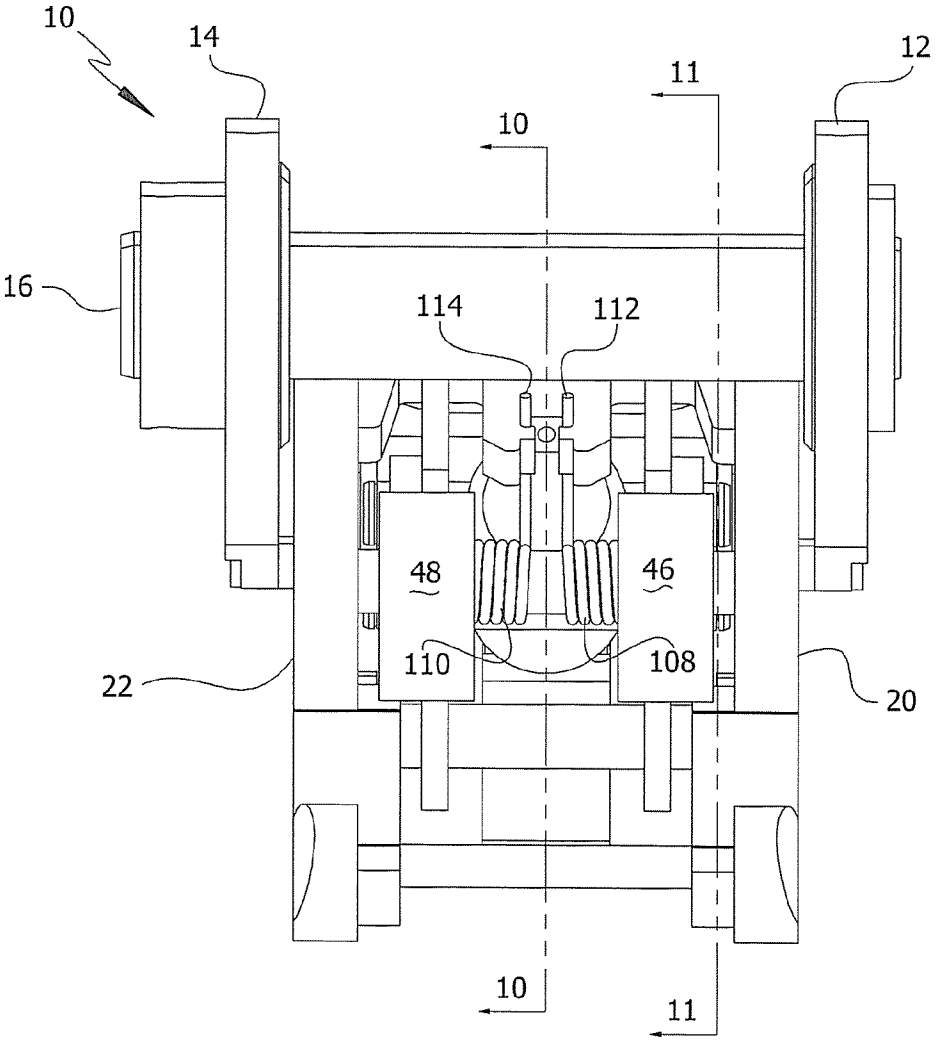
FIGS. 9 and 28 are respectively right and left side front elevation views, on an enlarged scale, of the FIG. 8 coupler.
Figure 27:
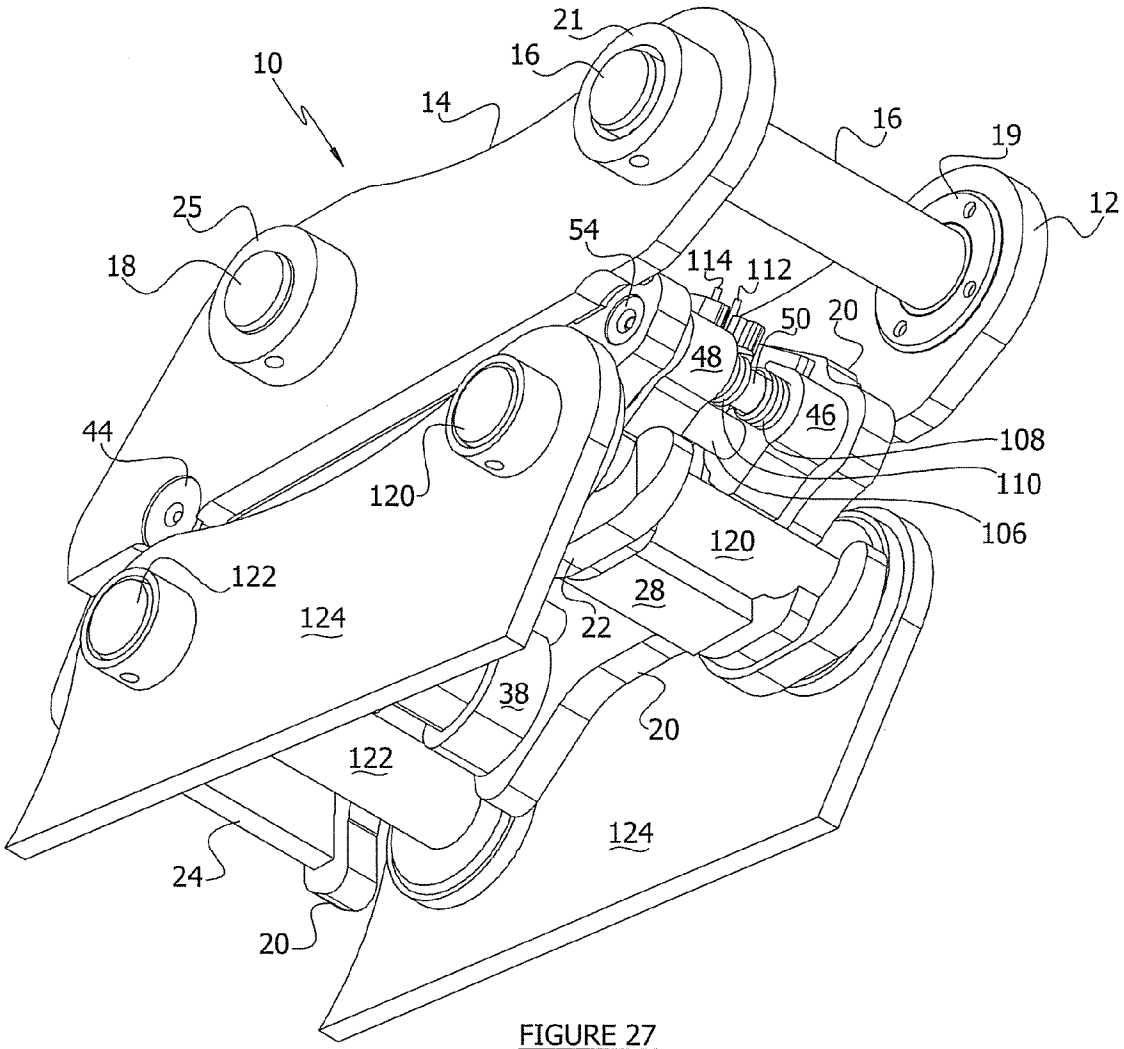
Figure 28:
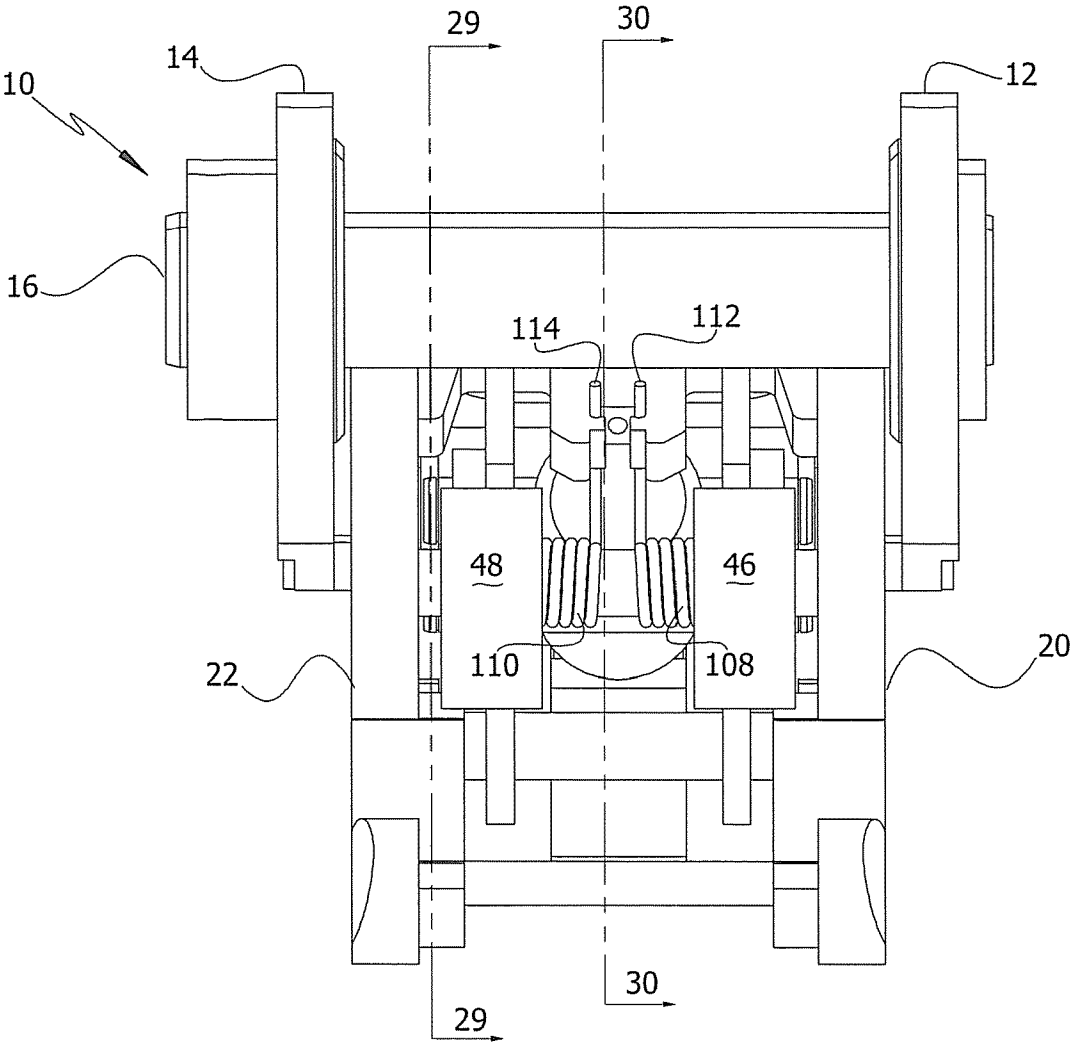

The operator then manoeuvres the machine's boom to position forward mounting pin 120 of implement 124 within coupler 10's forward pin-receiving receiving aperture 30 and to position implement 124's rearward mounting pin 122 within coupler 10's rearward pin-receiving aperture 32 as shown in FIGS. 8 and 27.

Figure 14:
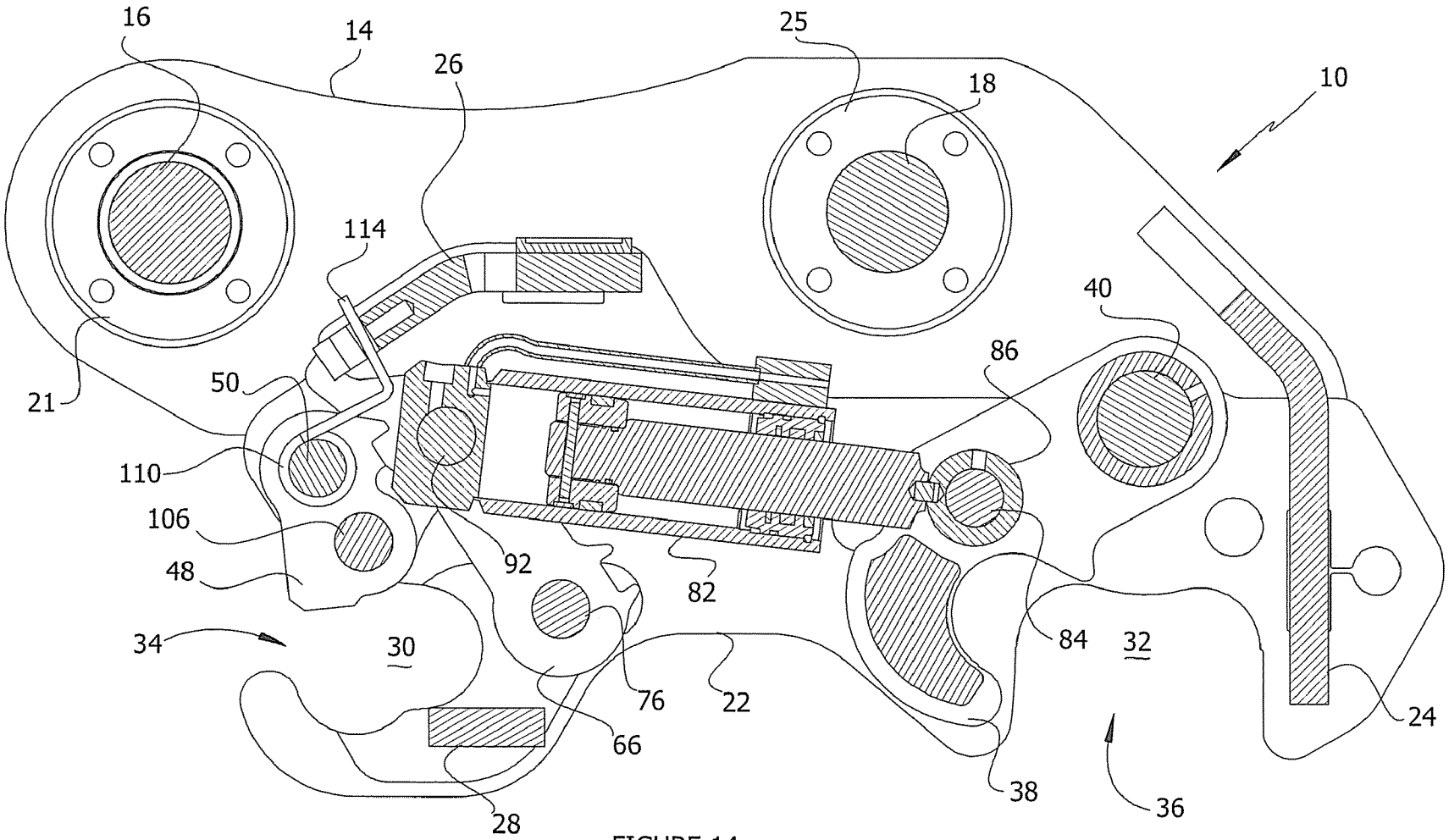
FIGS. 14 and 33 are respectively right and left side section views, on an enlarged scale, taken (FIG. 14) with respect to line 14-14 shown in FIG. 13 and (FIG. 33) with respect to line 33-33 shown in FIG. 32.
Figure 15:
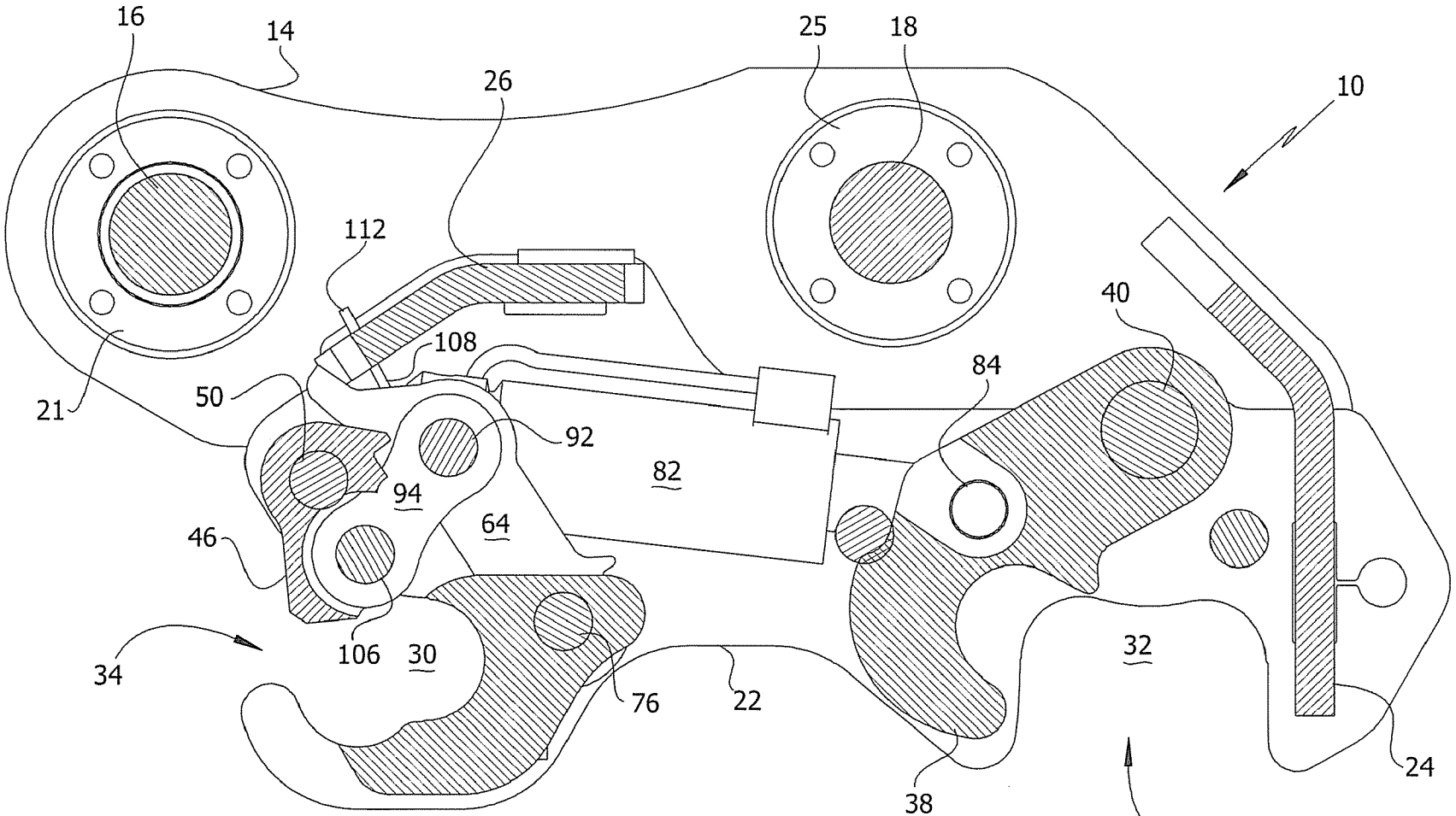
FIGS. 15 and 34 are respectively right and left side section views, on an enlarged scale, taken (FIG. 15) with respect to line 15-15 shown in FIG. 13 and (FIG. 34) with respect to line 34-34 shown in FIG. 32.
Figure 16:
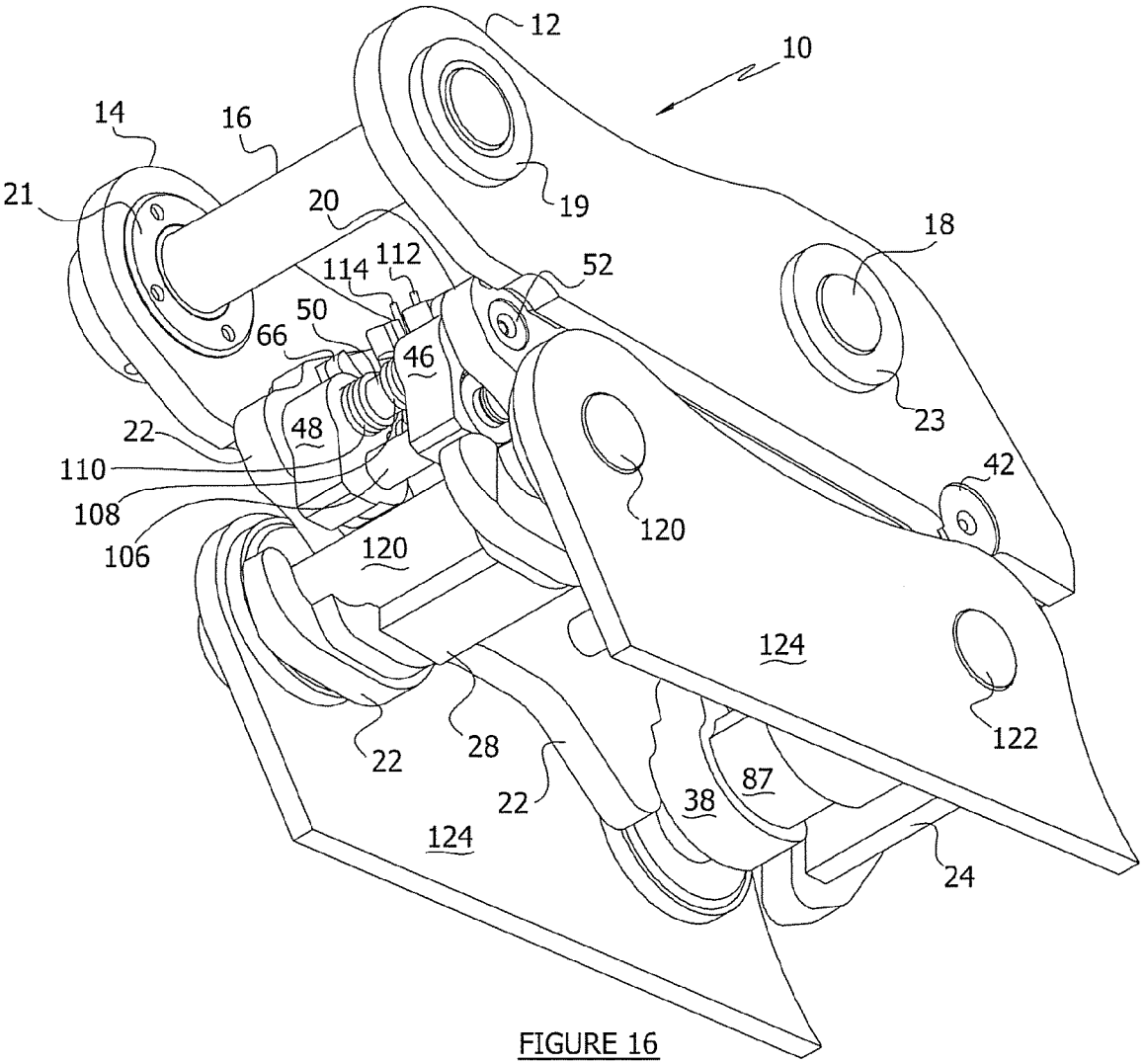
FIGS. 16 and 35 are similar to FIGS. 8 and 27; and to FIGS. 12 and 31 respectively, but show the coupler after activation of both the safety locks and the latching hook.
Figure 17:
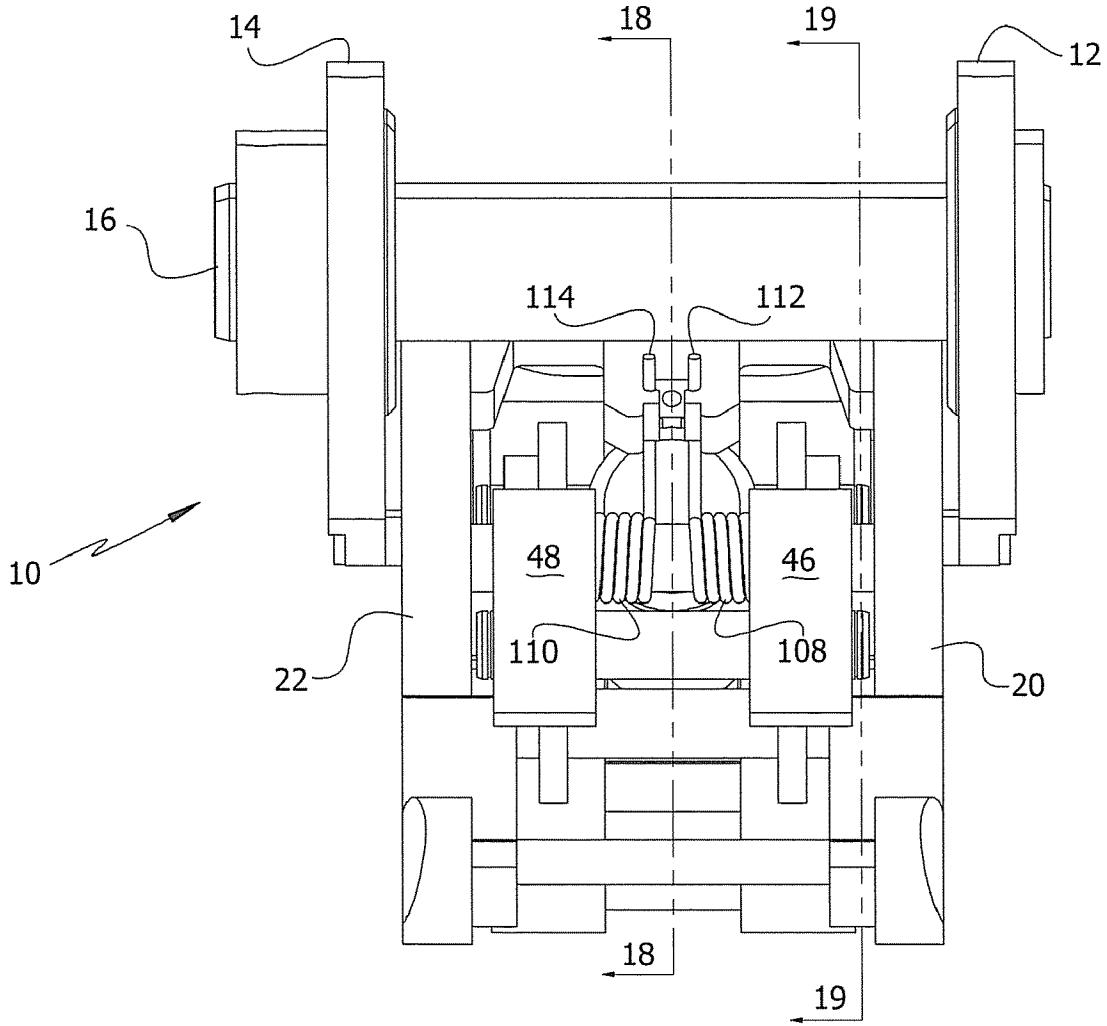
FIGS. 17 and 36 are respectively front elevation views, on an enlarged scale, of the coupler shown in FIGS. 16 coupler and 35 respectively.
Figure 33:
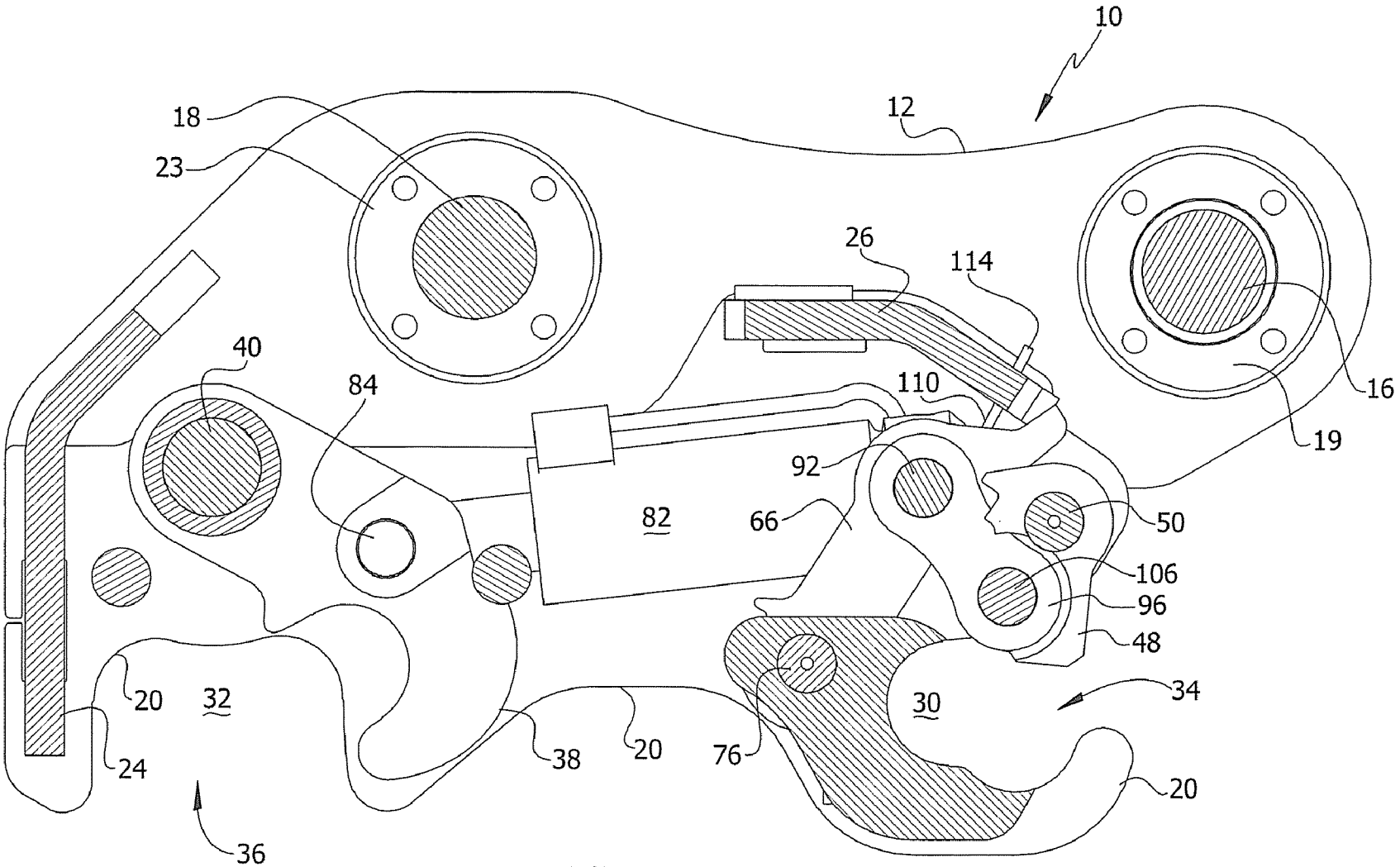
Figure 34:
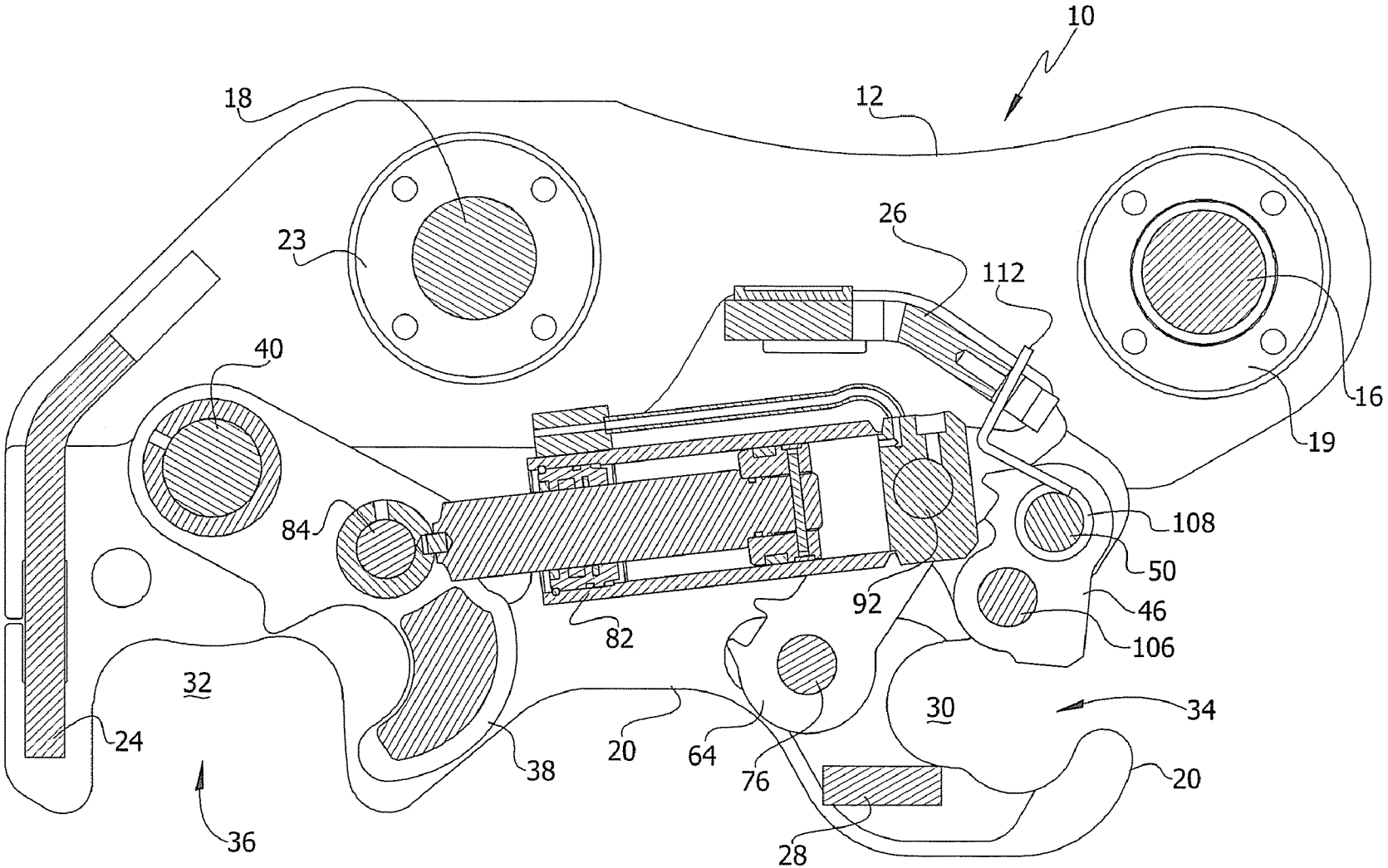
Figure 35:
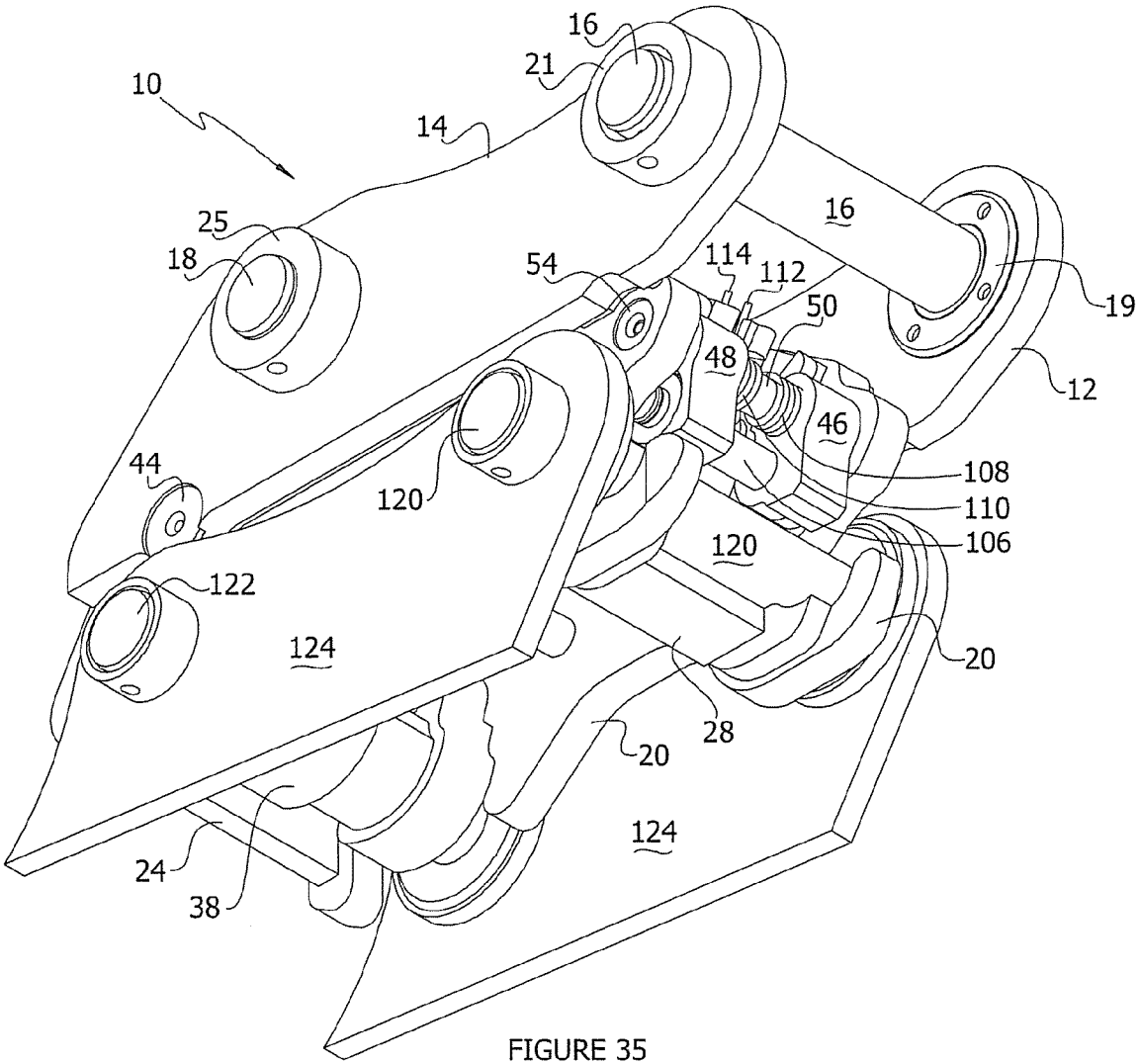
Figure 36:
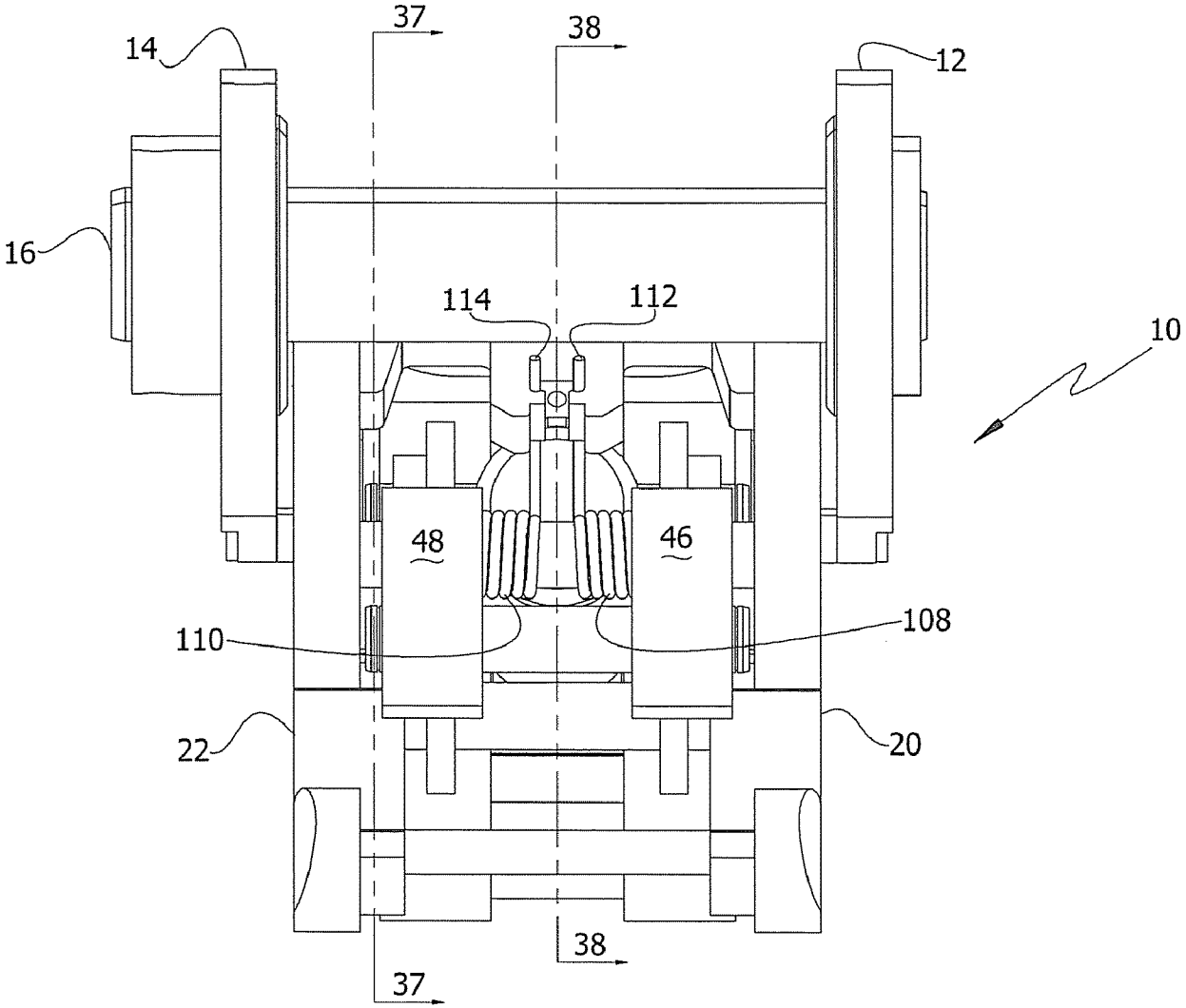
Figure 37:
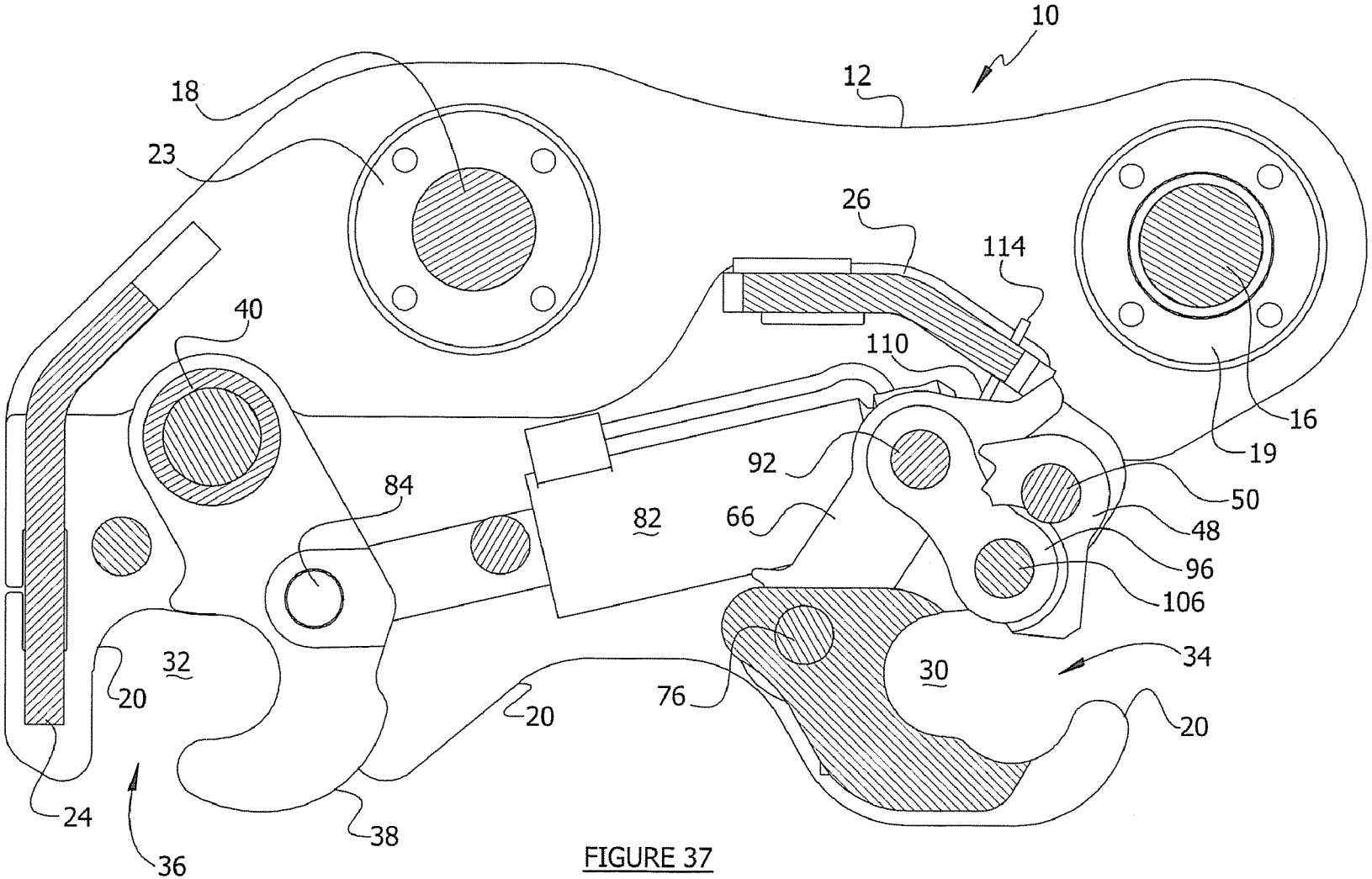
Figure 38:
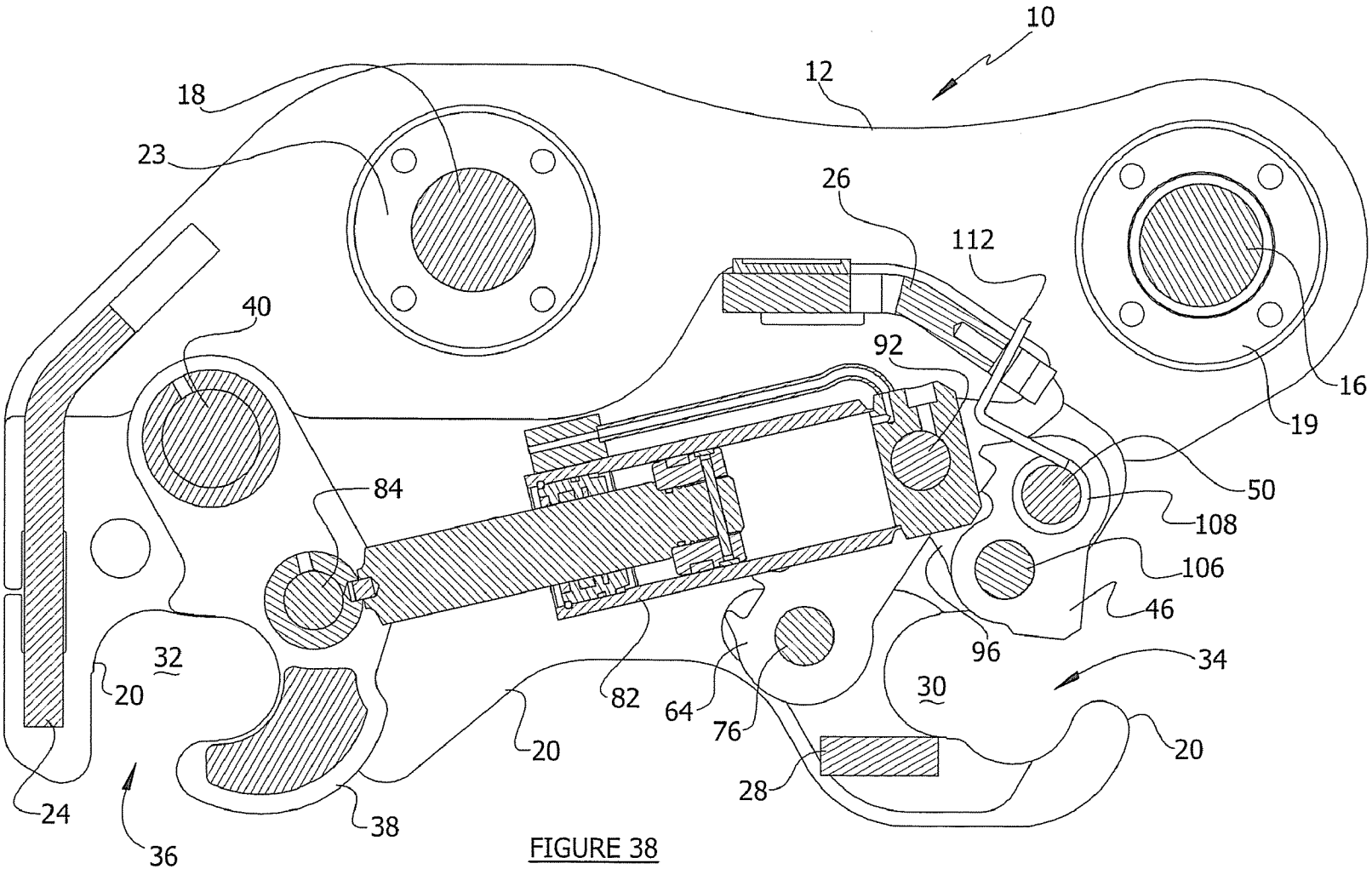

The operator next actuates the aforementioned control system to extend the cylinder end of hydraulic cylinder 82 to the left, as viewed in FIGS. 14-15 (i.e. to the right, as viewed in FIGS. 33-34). Such extension pivots cylinder mount links 64, 66 forwardly (i.e. counterclockwise about pivot pin 76, as viewed in FIGS. 14-15; and clockwise about pivot pin 76, as viewed in FIGS. 33-34). Such pivotal movement of cylinder mount links 64, 66 moves lock links 94, 96 forwardly on cylinder end pivot pin 92. Since lock links 94, 96 are coupled between cylinder mount links 64, 66 and safety locks 46, 48 on pivot pins 76, 106 respectively, safety locks 46, 48 are also drawn forwardly (i.e. pivoted clockwise about safety lock upper pivot pin 50 as viewed in FIGS. 14-15; and counterclockwise about pin 50 as viewed in FIGS. 33-34), such that safety locks 46, 48 extend within aperture 30 atop implement 124's forward mounting pin 120. The ratchet faces 55, 59 of safety locks 46, 48 engage the locking faces 67, 71 of cylinder mount links 64, 66 preventing withdrawal of pin 120 from aperture 30 as shown in FIGS. 12-15 and 31-34. Springs 108, 110 bias safety locks 46, 48 clockwise with respect to safety lock upper pivot pin 50 as viewed in FIGS. 14-15 (i.e. counterclockwise as viewed in FIGS. 33-34) maintaining engagement of safety locks 46, 48 atop pin 120 and preventing withdrawal of pin 120 from aperture 30 in the event of a hydraulic system failure.

Figure 18:
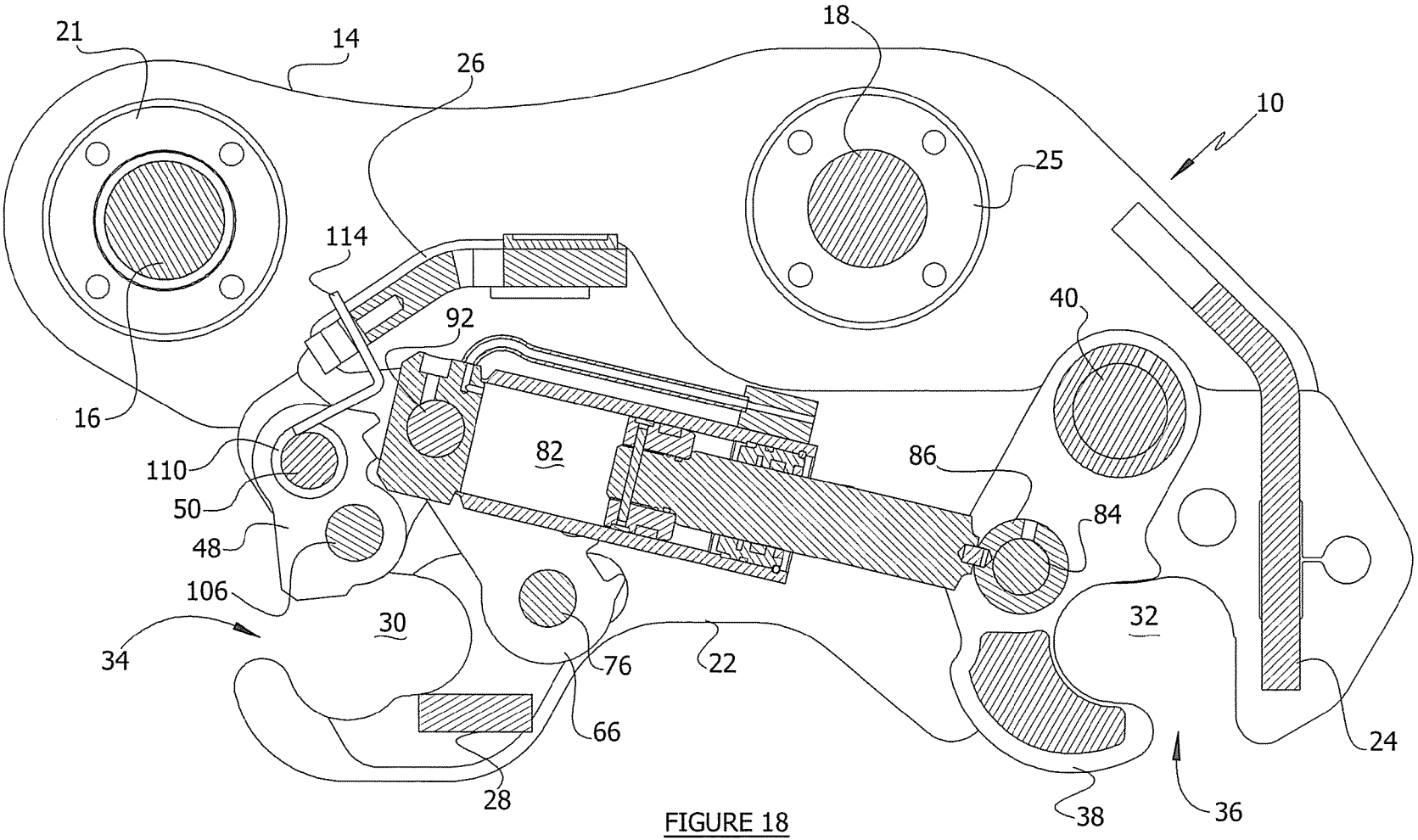
FIGS. 18 and 37 are respectively right and left side section views, on an enlarged scale, taken (FIG. 18) section view taken with respect to line 18-18 shown in FIG. 17 and (FIG. 37) with respect to line 37-37 shown in FIG. 36.
Figure 19:
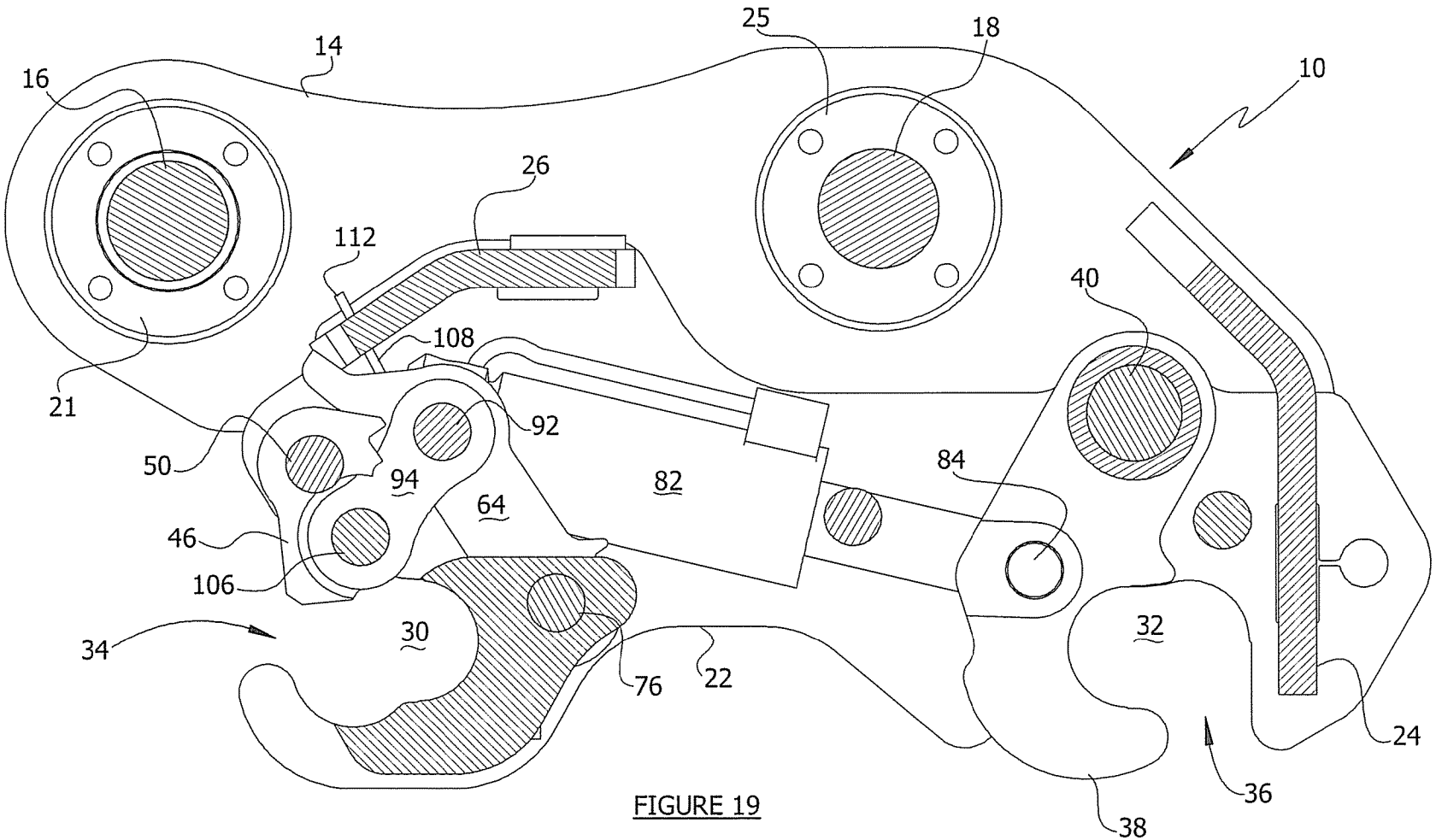
FIGS. 19 and 38 are respectively right and left side section views, on an enlarged scale, taken (FIG. 19) with respect to line 19-19 shown in FIG. 17 and (FIG. 38) with respect to line 38-38 shown in FIG. 36.

The operator continues to extend the rod end of hydraulic cylinder 82 to the right, as viewed in FIGS. 18-19 (i.e. to the left, as viewed in FIGS. 37-38), thereby pivoting latching hook 38 counterclockwise about pivot pin 40 as viewed in FIGS. 18-19 (i.e. clockwise about pivot pin 40 as viewed in FIGS. 37-38) to extend latching hook 38 into rearward aperture 32 beneath implement 124's rearward mounting pin 122, preventing withdrawal of pin 122 from aperture 32 as shown in FIGS. 16-19 and 35-38.

To release implement 124 from coupler 10, the operator first actuates the aforementioned control system to retract hydraulic cylinder 82's rod end to the left as viewed in FIGS. 14-15 (i.e. to the right as viewed in FIGS. 33-34). Such retraction pivots latching hook 38 forwardly (i.e. clockwise about pivot pin 40 as viewed in FIGS. 14-15; and counterclockwise about pivot pin 40 as viewed in FIGS. 33-34) into the position shown in FIGS. 12-15 and 31-34 in which latching hook 38 is clear of rearward aperture 32. The operator continues to retract hydraulic cylinder 82's cylinder end to the right as viewed in FIGS. 10-11 (i.e. to the left as viewed in FIGS. 29-30). Such retraction pivots cylinder mount links 64, 66 rearwardly, drawing lock links 94, 96 rearwardly on cylinder end pivot pin 92 thereby overcoming the biasing of springs 108, 110 and drawing safety locks 46, 48 rearwardly such that safety locks 46, 48 are clear of aperture 30 as shown in FIGS. 8-11 and 27-30. It will be noted that springs 108, 110 maintain engagement of safety locks 46, 48 atop pin 120 during release of implement 124 from coupler 10 until the final phase of the release operation in which the springs'biasing is overcome as aforesaid, thus preventing withdrawal of pin 120 from aperture 30 in the event of a hydraulic system failure before completion of the release operation.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A coupler, comprising:

first and second spaced-apart, substantially parallel upper side plates;

first and second spaced-apart, substantially parallel lower side plates, the first lower side plate fixed to and extending downwardly from the first upper side plate and the second lower side plate fixed to and extending downwardly from the second upper side plate;

a first pin-receiving aperture formed in a forward end of the first lower side plate and a second pin-receiving aperture formed in a forward end of the second lower side plate in transverse alignment with the first pin-receiving aperture;

a third pin-receiving aperture formed in a rearward end of the first lower side plate and a fourth pin-receiving aperture formed in a rearward end of the second lower side plate in transverse alignment with the third pin-receiving aperture;

a first mounting pin mounted between forward ends of the first and second upper side plates;

a second mounting pin mounted between rearward ends of the first and second upper side plates;

a safety lock pivotally mounted between the first and second lower side plates for pivotal movement of the safety lock between an unlocked position in which the safety lock is rearward of the first and second pin-receiving apertures and does not contact a first implement pin receivable within the first and second pin-receiving apertures, and a locked position in which the safety lock extends forwardly into the first and second pin-receiving apertures to contact and retain the first implement pin within the first and second pin-receiving apertures;

a latching hook pivotally mounted between the first and second lower side plates for pivotal movement of the latching hook between an unlatched position in which the latching hook is forward of the third and fourth pin-receiving apertures and does not contact a second implement pin receivable within the third and fourth pin-receiving apertures, and a latched position in which the latching hook extends rearwardly into the third and fourth pin-receiving apertures to retain the second implement pin within the third and fourth pin-receiving apertures;

a power cylinder pivotally coupled between the latching hook and the safety lock at opposing cylinder ends, the power cylinder selectably actuatable to pivotally move the latching hook between the unlatched and latched positions;

a first link having one end pivotally mounted between the first and second lower side plates and an opposite end pivotally coupled to the power cylinder;

a second link pivotally coupled to the power cylinder and pivotally coupled to the safety lock; and a third pin extending through the first and second links and pivotally coupling the opposite end of the first link to the power cylinder and pivotally coupling the power cylinder to the second link;

wherein actuation of the power cylinder to pivotally move the latching hook into the latched position pivotally moves the first link and the second link to pivotally move the safety lock into the locked position.

2. A coupler as defined in claim 1, wherein the safety lock is forwardly pivotally biased toward the first and second pin-receiving apertures.

3. A coupler as defined in claim 2, wherein the first mounting pin is rotatably mounted between the first and second upper side plates and the second mounting pin is fixed between the first and second upper side plates.

4. A coupler as defined in claim 3, wherein the first and second pin-receiving apertures have upward and forward-facing openings and the third and fourth pin-receiving apertures have downward-facing openings.

5. A coupler as defined in claim 4, further comprising a spring pivotally biasing the safety lock toward the locked position.

6. A coupler as defined in claim 1, wherein actuation of the power cylinder to pivotally move the latching hook into the latched position further braces the first link against the safety lock inhibiting movement of the safety lock away from the locked position.

7. A coupler, comprising:

first and second spaced-apart, substantially parallel upper side plates;

first and second spaced-apart, substantially parallel lower side plates, the first lower side plate fixed to and extending downwardly from the first upper side plate and the second lower side plate fixed to and extending downwardly from the second upper side plate;

a first pin-receiving aperture formed in a forward end of the first lower side plate and a second pin-receiving aperture formed in a forward end of the second lower side plate in transverse alignment with the first pin-receiving aperture;

a third pin-receiving aperture formed in a rearward end of the first lower side plate and a fourth pin-receiving aperture formed in a rearward end of the second lower side plate in transverse alignment with the third pin-receiving aperture;

a first mounting pin mounted between forward ends of the first and second upper side plates;

a second mounting pin mounted between rearward ends of the first and second upper side plates;

first and second safety locks pivotally mounted between the first and second lower side plates for pivotal movement of the first and second safety locks between an unlocked position in which the first and second safety locks are rearward of the first and second pin-receiving apertures and do not contact a first implement pin receivable within the first and second pin-receiving apertures, and a locked position in which the first and second safety locks extend forwardly into the first and second pin-receiving apertures to contact and retain the first implement pin within the first and second pin-receiving apertures;

a latching hook pivotally mounted between the first and second lower side plates for pivotal movement of the latching hook between an unlatched position in which the latching hook is forward of the third and fourth pin-receiving apertures and does not contact a second implement pin receivable within the third and fourth pin-receiving apertures, and a latched position in which the latching hook extends rearwardly into the third and fourth pin-receiving apertures to retain the second implement pin within the third and fourth pin-receiving apertures;

a power cylinder pivotally coupled between the latching hook and the first and second safety locks at opposing cylinder ends, the power cylinder selectably actuatable to pivotally move the latching hook between the unlatched and latched positions;

a first link having one end pivotally mounted toward a first side of the coupler between the first and second lower side plates and an opposite end pivotally coupled to the power cylinder;

a second link having one end pivotally mounted toward a second side of the coupler between the first and second lower side plates and an opposite end pivotally coupled to the power cylinder;

a third link pivotally coupled, toward the first side of the coupler, to the power cylinder and pivotally coupled to the first safety lock;

a fourth link pivotally coupled, toward the second side of the coupler, to the power cylinder and pivotally coupled to the second safety lock; and a cylinder end pivot pin extending through the first, second, third and fourth links, the cylinder end pivot pin pivotally coupling the opposite end of the first link to the power cylinder and pivotally coupling the opposite end of the second link to the power cylinder and pivotally coupling the power cylinder to the third link and pivotally coupling the power cylinder to the fourth link;

wherein:

selectable actuation of the power cylinder selectably pivotally moves the latching hook between the unlatched and latched positions;

actuation of the power cylinder to pivotally move the latching hook into the latched position pivotally moves the first link and the third link to pivotally move the first safety lock into the locked position; and actuation of the power cylinder to pivotally move the latching hook into the latched position further moves the second link and the fourth link to pivotally move the second safety lock into the locked position.

8. A coupler as defined in claim 7, wherein the first and second safety locks are forwardly pivotally biased toward the first and second pin-receiving apertures.

9. A coupler as defined in claim 8, wherein:

the first mounting pin is rotatably mounted between the first and second upper side plates;

the second mounting pin is fixed between the first and second upper side plates;

the first and second pin-receiving apertures have upward and forward-facing openings; and the third and fourth pin-receiving apertures have downward-facing openings.

10. A coupler as defined in claim 8, wherein the first safety lock is mounted toward the first side of the coupler and the second safety lock is mounted toward the second side of the coupler opposite the first side of the coupler.

11. A coupler as defined in claim 10, wherein:

actuation of the power cylinder to pivotally move the latching hook into the latched position further braces the first link against first safety lock, inhibiting movement of the first safety lock away from the locked position; and actuation of the power cylinder to pivotally move the latching hook into the latched position further braces the second link against the second safety lock, inhibiting movement of the second safety lock away from the locked position.

12. A coupler as defined in claim 10, further comprising:

a third pin pivotally coupling the latching hook between the first and second lower side plates;

a fourth pin pivotally coupling the power cylinder to the latching hook;

a fifth pin pivotally coupling the one end of the first link between the first and second lower side plates and pivotally coupling the one end of the second link between the first and second lower side plates;

a sixth pin pivotally coupling the third link to the first safety lock and pivotally coupling the fourth link to the second safety lock; and a seventh pin pivotally coupling the first safety lock between the first and second lower side plates and pivotally coupling the second safety lock between the first and second lower side plates.

13. A coupler as defined in claim 12, wherein:

selectable actuation of the power cylinder moves the power cylinder between a retracted position and an extended position;

movement of the power cylinder into the retracted position pivots the latching hook forwardly about the third pin into the unlatched position;

movement of the power cylinder into the retracted position further pivots the first link and the second link rearwardly about the fifth pin;

movement of the power cylinder into the retracted position further pivots the third link and the fourth link rearwardly about the cylinder end pivot pin; and rearward pivotal movement of the third link and the fourth link about the cylinder end pivot pin further pivots the first safety lock and the second safety lock rearwardly about the seventh pin.

14. A coupler as defined in claim 13, wherein:

rearward pivotal movement of the first link moves the first link away from the first safety lock, permitting movement of the first safety lock away from the locked position; and rearward pivotal movement of the second link moves the second link away from the second safety lock, permitting movement of the second safety lock away from the locked position.

15. A coupler as defined in claim 12, wherein:

selectable actuation of the power cylinder moves the power cylinder between a retracted position and an extended position;

movement of the power cylinder into the extended position pivots the first link and the second link forwardly about the fifth pin;

movement of the power cylinder into the extended position further pivots the third link and the fourth link forwardly about the cylinder end pivot pin; and forward pivotal movement of the third link and the fourth link further pivots the first safety lock and the second safety lock forwardly about the seventh pin into the locked position.

16. A coupler as defined in claim 15, wherein:

forward pivotal movement of the first link braces the first link against the first safety lock, inhibiting movement of the first safety lock away from the locked position; and forward pivotal movement of the second link braces the second link against the second safety lock, inhibiting movement of the second safety lock away from the locked position.

17. A coupler as defined in claim 7, further comprising:

a first spring pivotally biasing the first safety lock toward the locked position; and a second spring pivotally biasing the second safety lock toward the locked position.

* * * * *